US011059052B2

(12) United States Patent
Yossifon et al.

(10) Patent No.: US 11,059,052 B2
(45) Date of Patent: Jul. 13, 2021

(54) DEVICE AND METHOD FOR CONTROLLING ELECTRICAL FIELD

(71) Applicant: Technion Research & Development Foundation Limited, Haifa (IL)

(72) Inventors: Gilad Yossifon, Mazkeret Batia (IL); Alicia Boymelgreen, Zikhron-Yaakov (IL)

(73) Assignee: Technion Research & Development Foundation Limited, Haifa (IL)

( * ) Notice: Subject to any disclaimer, the term of this patent is extended or adjusted under 35 U.S.C. 154(b) by 144 days.

(21) Appl. No.: 16/306,916

(22) PCT Filed: Jun. 2, 2017

(86) PCT No.: PCT/IL2017/050618

§ 371 (c)(1),
(2) Date: Dec. 4, 2018

(87) PCT Pub. No.: WO2017/212475

PCT Pub. Date: Dec. 14, 2017

(65) Prior Publication Data

US 2019/0217309 A1 Jul. 18, 2019

(30) Foreign Application Priority Data

Jun. 5, 2016 (IL) ..... 246027

(51) Int. Cl.
*B03C 5/02* (2006.01)
*B03C 5/00* (2006.01)

(52) U.S. Cl.
CPC ..... *B03C 5/005* (2013.01); *B03C 5/026* (2013.01); *B03C 5/028* (2013.01); *B03C 2201/26* (2013.01)

(58) Field of Classification Search
CPC ..... B03C 5/005; B03C 5/026; B03C 5/028; B03C 2201/26
See application file for complete search history.

(56) References Cited

U.S. PATENT DOCUMENTS

2005/0211557 A1* 9/2005 Childers ..... B03C 5/028 204/547
2006/0175192 A1 8/2006 Lin
(Continued)

FOREIGN PATENT DOCUMENTS

WO WO 2008/117192 10/2008
WO WO 2017/212475 12/2017

OTHER PUBLICATIONS

Suzuki et al., "Validity of Fluctuation Theorem on Self-Propelling Particles," arXiv:1104.5607 (Year: 2011).*
(Continued)

*Primary Examiner* — Angelo Trivisonno

(57) ABSTRACT

A method for dielectrophoresis includes applying an electric field across a micro-fluidic chamber with an alternating current (AC), trapping the target particles on the at least one carrier particle, transporting the target particles from a first location in the chamber to a second location in the chamber distanced from the first location with the at least one carrier particle and dynamically controlling the trapping and the transporting based on remotely applying forces on the at least one carrier particle. The trapping is based on localized gradients of the electric field induced by the carrier particle. The applied electric field is uniform absent a carrier particle present in the micro-fluidic chamber. The micro-fluidic chamber contains an electrolyte-solution with suspended target particles and at least one carrier particle freely floating on or in the electrolyte-solution.

31 Claims, 14 Drawing Sheets
(10 of 14 Drawing Sheet(s) Filed in Color)

(56) References Cited

U.S. PATENT DOCUMENTS

| | | | | |
|---|---|---|---|---|
| 2010/0213081 | A1 | 8/2010 | Ozaki et al. | |
| 2013/0292247 | A1* | 11/2013 | Peyrade | B03C 5/005 204/518 |
| 2013/0306479 | A1 | 11/2013 | Aubry et al. | |

OTHER PUBLICATIONS

Baraban et al., "Catalytic Janus Motors on Microfluidic Chip: Deterministic Motion for Targeted Cargo Delivery," ACS Nano 2012, 6, 4, 3383-3389 (Year: 2012).*

International Preliminary Report on Patentability dated Dec. 20, 2018 From the International Bureau of WIPO Re. Application No. PCT/IL2017/050618. (6 Pages).

International Search Report and the Written Opinion dated Aug. 30, 2017 From the International Searching Authority Re. Application No. PCT/IL2017/050618. (9 Pages).

Boymelgreen et al. "Observing Electrokinetic Janus Particle—Channel Wall Interaction Using Microparticle Image Velocimetry", Langmuir, 31(30): 8243-8250, Published Online Jul. 6, 2015.

Supplementary Partial European Search Report and the European Provisional Opinion dated Dec. 19, 2019 From the European Patent Office Re. Application No. 17809839.8.

Baraban et al. "Catalytic Janus Motors on Microfluidic Chip: Deterministic Motion for Targeted Cargo Delivery", ACS Nano, XP055652347, 6(4): 3383-3389, Published Online Mar. 16, 2012.

Chen et al. "Janus Particle Microshuttle: 1D Directional Self-Propulsion Modulated by AC Electrical Field", AIP Advances, XP012183083, 493): 031325-1-031325-9, Published Online Mar. 11, 2014.

Gangwal et al. "Dielectrophoretic Assembly of Metallodielectric Janus Particles in AC Electric Fields", Langmuir, XP055652127, 24(23): 13312-13320, Published on Web Oct. 31, 2008.

Velev et al. "Particle-Localized AC and DC Manipulation and Electrokinetics", Annual Reports Section C, Physical Chemistry, XP055142026, 105: 213-246, 2009.

Zhang et al. "Dielectrophoresis of Janus Particles Under High Frequency AC-Electric Fields", Applied Physics Letters, XP012130682, 96(14): 141902-1 141902-3, Published Online Apr. 5, 2010.

* cited by examiner

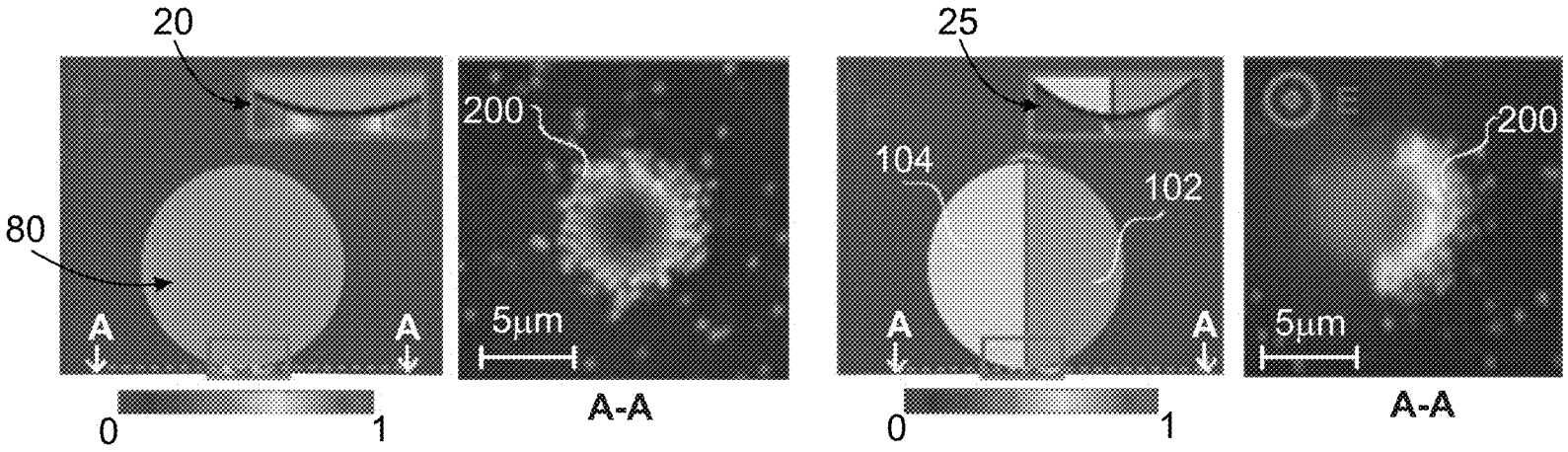
FIG. 1A
FIG. 1B
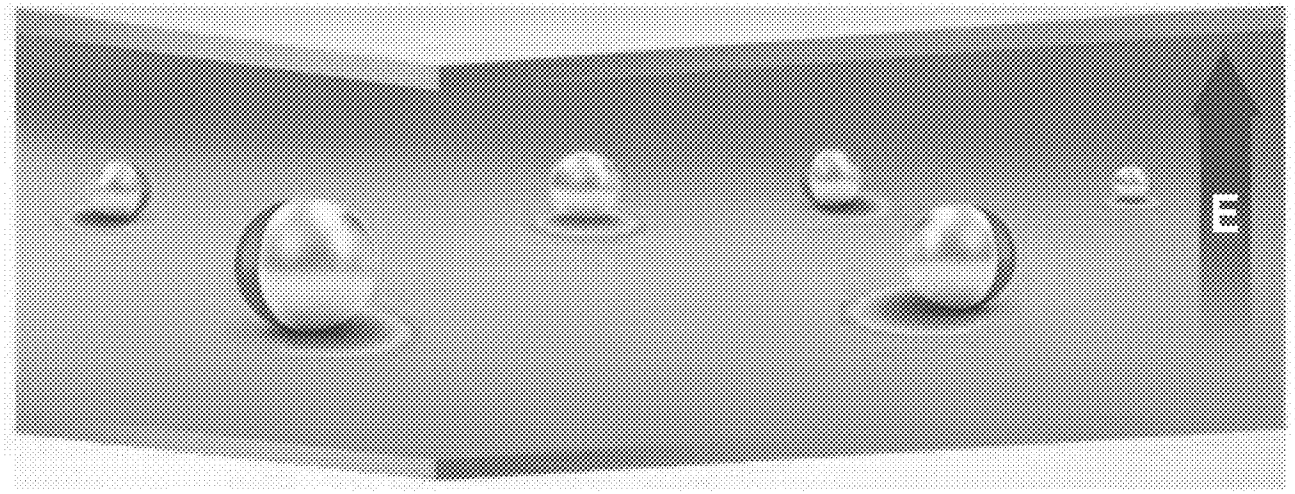
FIG. 1C

Section B-B

Section C-C a) ω = 100kHz b) ω = 1kHz c) ω = 750kHz d) ω = 2MHz b)

c)

a)

FIG. 16A
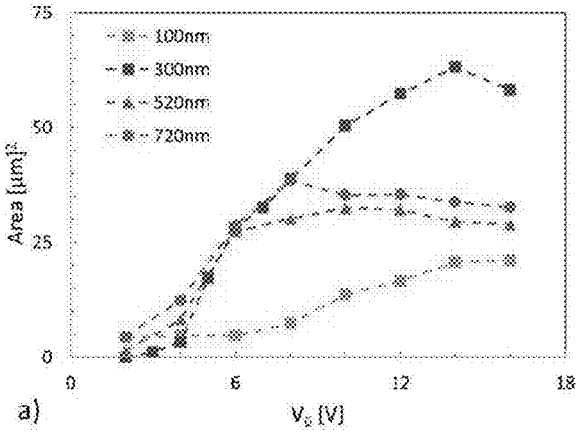
FIG. 16B
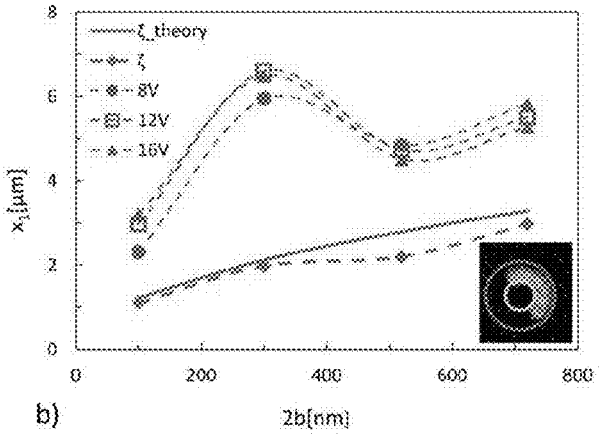
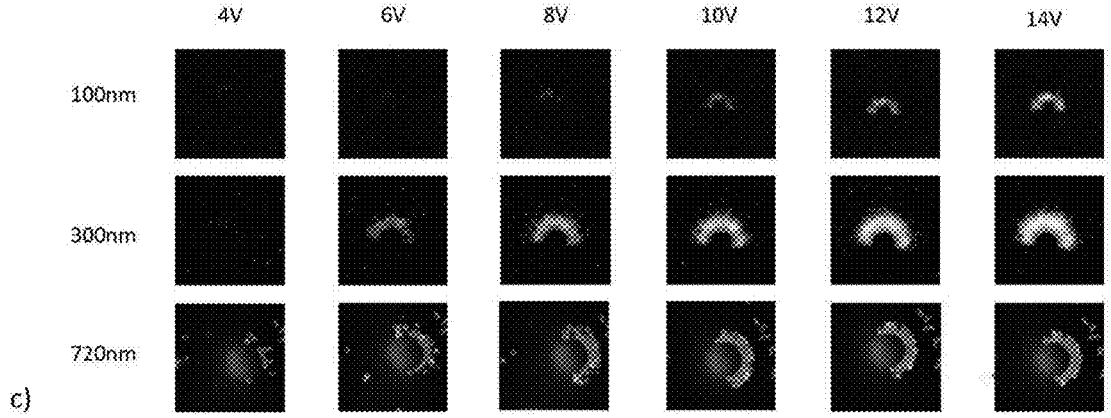
FIG. 16C

DEVICE AND METHOD FOR CONTROLLING ELECTRICAL FIELD

RELATED APPLICATIONS

This application is a National Phase of PCT Patent Application No. PCT/IL2017/050618 having International filing date of Jun. 2, 2017, which claims the benefit of priority of Israeli Patent Application No. 246027 filed on Jun. 5, 2016. The contents of the above applications are all incorporated by reference as if fully set forth herein in their entirety.

FIELD AND BACKGROUND OF THE INVENTION

The present invention, in some embodiments thereof, relates to an electrical field control and, more particularly, but not exclusively, to a device and method which can trap target particles by dielectrophoresis, transport target particles by dielectrophoresis, and/or alter electric field gradient within a chamber.

Dielectrophoresis (DEP) is a known method of separation and concentration of both inorganic and biological matter. DEP occurs when a polarizable particle is suspended in a non-uniform electric field. The electric field polarizes the particle, and the poles then experience a force along the field lines, which can be either attractive termed positive DEP (p-DEP) or repulsive, termed negative DEP (n-DEP) according to the orientation on the dipole. The transition frequency from p-DEP to n-DEP behavior and vice versa is known as the cross-over frequency (COF) and depends on the combination of geometrical and electrical properties, e.g. conductivity or permittivity properties of both the target particle and the solution in which it is suspended. The COF corresponds exactly to when the Clausius-Mossotti (CM) factor, that combines the former electrical and geometrical parameters, vanishes. Some micro-fabricated DEP devices apply far-field electro-convection effects such as alternating-current electro-osmosis (ACEO) or induced charge electro-osmosis (ICEO) to rapidly concentrate target particles from a suspending solution to locations where they can be trapped. These DEP devices typically rely on inbuilt geometric asymmetry to induce the electric field gradients required. Some known devices embed metal electrodes to generate the spatially non-uniform, time-varying (AC) electric fields. In other known devices insulating posts are positioned in a channel of a microchip to produce the spatially non-uniform fields. Typically, active sites of known DEP devices are predetermined and prescribed by the chip design.

U.S. Pat. No. 8,357,279 entitled "Methods, apparatus and systems for concentration, separation and removal of particles at/from the surface of drops," the contents of which are incorporated herein by reference describe methods to concentrate or move particles on the surface of a liquid drops within a liquid or gas continuous phase or gaseous bubbles within a liquid continuous phase. The methods can be used to separate different types of particles on the drop or bubble either to remove them from the drop or bubble or to produce a pattern of particles on the drop or bubble, and to coalesce drops or bubbles. The technique uses an externally applied electric field that is typically uniform to move particles on a surface of a drop suspended in a medium. In an electric field, such as in a uniform field, the electric field's non-uniformity in the vicinity and on the surface of drop results in dielectrophoretic motion of the particles on the surface of the drop.

SUMMARY OF THE INVENTION

According to an aspect of some embodiments of the present invention there is provided a device and method that controls spatio-temporal distribution of an electric field via mobile particles or multi-particle structures.

According to an aspect of some embodiments of the present invention there is provided a device and method that can perform separation and concentration at a dynamically controlled location without the need for patterning the micro-fluid chamber with a specified design. According to an aspect of some embodiments of the present invention, the device includes carrier particles suspended in a solution that serve as both a trapping site for target particles and a vehicle for transporting the target particles trapped to a desired location in the chamber.

According to of some embodiments of the present invention, a driving electric field gradient is locally induced by the particle itself due to its proximity to the conducting channel wall of the device even under uniform external applied electric field. In some exemplary embodiments, when the carrier particle is formed with a complex geometry, e.g. two or more particles forming a doublet or an otherwise non-spherical particle, the electric field gradient may also be locally induced due to highly symmetry broken carrier particle geometry irrespective of its proximity to the wall. In some exemplary embodiments, both the trapping and the transportation are controlled by manipulating frequency and amplitude of the external electric field to induce the desired gradient. In other exemplary embodiments, trapping is controlled by the electric field while transportation is controlled based on dynamic control of another independent physical mechanism, e.g. magnetic or optical force. Optionally, releasing is also controlled by manipulating the frequency of the external electric field. Since the device and method does not rely on a specific micro-fluidic chamber design or patterning, it may be adapted to specific needs and experimental conditions on demand and in real time.

According to an aspect of some exemplary embodiments there is provided a method for dielectrophoresis (DEP), the method comprising: applying an electric field across a micro-fluidic chamber with an alternating current (AC), wherein the electric field is uniform absent a carrier particle present in the micro-fluidic chamber; wherein the micro-fluidic chamber contains an electrolyte-solution with suspended target particles and at least one carrier particle freely floating on or in the electrolyte-solution; trapping the target particles on the at least one carrier particle based on localized gradients of the electric field induced by the carrier particle; transporting the target particles from a first location in the chamber to a second location in the chamber distanced from the first location with the at least one carrier particle; and dynamically controlling the trapping and the transporting based on remotely applying forces on the at least one carrier particle.

Optionally, both the trapping and the transporting are dynamically controlled based on selection of a frequency of the AC.

Optionally, the trapping and the transporting are dynamically controlled based on selection of amplitude of the AC.

Optionally, dynamically controlling the transporting is based on selecting on demand a first pre-defined frequency configured to induce self DEP (s-DEP) on the at least one carrier particle.

Optionally, the at least one carrier particle is a symmetry broken particle.

Optionally, the at least one carrier particle is a Janus particle.

Optionally, the localized gradient induced is based on proximity of the particle to a conducting wall of the micro-fluidic chamber.

Optionally, the transporting is in a direction perpendicular to the direction of the electric field.

Optionally, the at least one carrier particle is at least one of a particle doublet, a cluster and a particle with non-spherical shape, and wherein the localized gradients induced is based on the geometric characteristics of the carrier particle.

Optionally, the trapping is dynamically controlled based on selection of a frequency of the AC electric field and the transporting is dynamically controlled based on an externally applied magnetic field.

Optionally, the trapping is dynamically controlled based on selection of a frequency of the AC electric field and the transporting is dynamically controlled based on an externally applied optical force.

Optionally, the at least one carrier particle is a homogenous particle.

Optionally, the at least one carrier particle includes magnetic functionalization.

Optionally, the magnetic functionalization is based on magnetic material coated on the carrier particle or a magnetic core of the carrier particle.

Optionally, the at least one carrier particle is functionalized with molecular biological probes.

Optionally, dynamically controlling the trapping is based on selecting on demand a second pre-defined frequency configured to induce positive DEP (p-DEP) on the target particles.

Optionally, dynamically controlling the release is based on selecting on demand a third pre-defined frequency configured to induce negative DEP (n-DEP) on the target particles.

Optionally, the method includes: applying a first electric field defined by a first pre-defined frequency for a first pre-defined time period, wherein the first pre-defined frequency is configured to induce p-DEP on the target particles; applying a second electric field defined by a second pre-defined frequency for a second pre-defined time period subsequent to the first pre-defined time period, wherein the second pre-defined frequency is configured to induce n-DEP of any contaminants attached to the carrier, and applying a third electric field defined by a third pre-defined frequency for a third pre-defined time period subsequent to the second pre-defined time period, wherein the third pre-defined frequency is configured to induce transporting of the target particles trapped on the at least one carrier particle.

According to an aspect of some exemplary embodiments there is provided a device for dielectrophoresis comprising: a micro-fluidic chamber comprising: an electrolyte-solution with suspended target particles; at least one carrier particle freely floating on or in the electrolyte-solution; a first electrode and second electrode, each abutting a floor or a ceiling of the chamber; an AC source applying AC current on the first and second electrode, wherein the AC current induces an electric field across the micro-fluidic chamber, wherein the electric field is uniform absent a carrier particle present in the micro-fluidic chamber; and controller configured to alter frequency of the AC, wherein the at least one carrier particle is configured to both trap the target particles and transport the target particles from a first location in the chamber to a second location in the chamber distanced from the first location in a direction perpendicular to the direction of the electric field based on forces applied remotely on the at least one carrier particle.

Optionally, both the controller is configured to dynamically control trapping and the transporting based on selection of a frequency of the AC.

Optionally, the controller is configured to select on demand a first pre-defined frequency configured to induce s-DEP of the at least one carrier particle.

Optionally, the at least one carrier particle is a symmetry broken particle.

Optionally, the at least one carrier particle is a Janus particle.

Optionally, the at least one carrier particle is at least one of a particle doublet, a cluster and a particle with a non-spherical shape.

Optionally, the controller is configured to dynamically control trapping based on selection of a frequency of the AC and is configured to dynamically control transporting based on an externally applied magnetic field.

Optionally, the at least one carrier particle is a homogenous particle.

Optionally, the at least one carrier particle includes magnetic functionalization.

Optionally, the at least one carrier particle is functionalized with molecular biological probes.

Optionally, the controller is configured to select on demand a second pre-defined frequency configured to induce p-DEP on the target particles.

Optionally, the controller is configured to select on demand a second pre-defined frequency configured to induce n-DEP on any contaminants.

Optionally, the controller is configured to select on demand a third pre-defined frequency configured to induce n-DEP on the target particles.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

The patent or application file contains at least one drawing executed in color. Copies of this patent or patent application publication with color drawing(s) will be provided by the Office upon request and payment of the necessary fee.

Some embodiments of the invention are herein described, by way of example only, with reference to the accompanying images and drawings. With specific reference now to the images and drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIGS. 1A and 1B is a schematic and accompanying microscope image depicting trapping with a symmetrical particle and trapping with a Janus particle, respectively, in accordance with some exemplary embodiments of the present invention;

FIG. 1C is a schematic illustration of a mobile microelectrode, according to some embodiments of the present invention; wherein localized gradients are induced around polarizable surface such that the spatial distribution of the field gradient is varied by manipulating the position of the exemplary Janus sphere;

FIG. 2 is an array of microscope images captured consecutively and depicting trapping and subsequent releasing of target particles in accordance with some exemplary embodiments of the present invention;

FIGS. 3A and 3B is a simplified schematic side and cross-section view respectively of a micro-fluidic chamber consisting of conducting channel walls and including a carrier particle for trapping and transporting target particles in accordance with some exemplary embodiments of the present invention;

FIGS. 3C and 3D is a simplified schematic side and cross-section view respectively of a micro-fluidic chamber including insulating channel walls, electrodes embedded on the substrate and a complex geometry carrier particle for trapping and transporting target particles in accordance with some exemplary embodiments of the present invention;

FIG. 4 is simplified schematic drawing showing trapping, transporting and release of exemplary target particles in accordance with some exemplary embodiments of the present invention;

FIGS. 5A, 5B, 5C, 5D and 5E are an array of exemplary microscope images captured over consecutive time periods that depict trapping and transporting of target particles under an electric field of 100 KHz and subsequent release of the target particles under and electric field of 2 MHZ in accordance with some exemplary embodiments of the present invention;

FIGS. 6A, 6B, 6C and 6D are simplified schematic drawings with accompanying exemplary microscope images that depict selecting trapping and release over four consecutive exemplary steps in accordance with some exemplary embodiments of the present invention;

FIG. 7 is a simplified flow chart of an exemplary method for dynamically controlling DEP in accordance with some exemplary embodiments of the present invention;

FIG. 8A is an exemplary graph showing frequency dispersion of 5 μm Janus carrier particles suspended in KCl electrolyte of varying concentration in accordance with some exemplary embodiments of the present invention;

FIGS. 8B and 8C are superimposed microscope images showing a path of 15 μm Janus carrier particles in $5\times10^{-4}$ M KCl at 50 KHz and at 1 MHz respectively in accordance with some exemplary embodiments of the present invention;

Figure 9B:
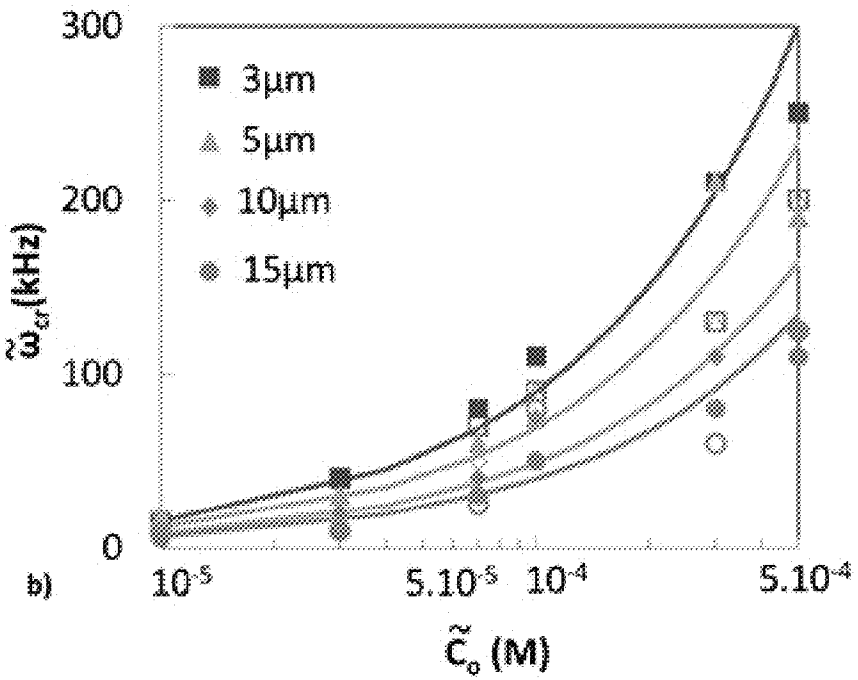
Figure 9A:
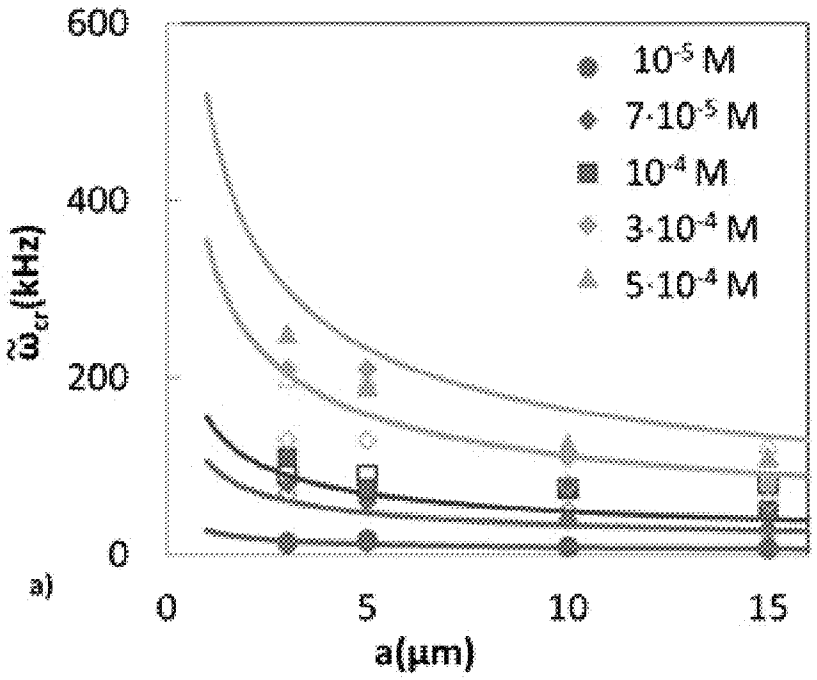
Figure 11A:
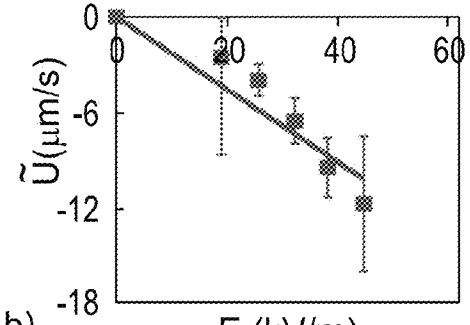
Figure 11B:
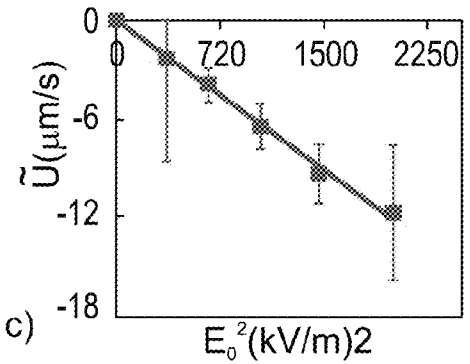
Figure 11C:
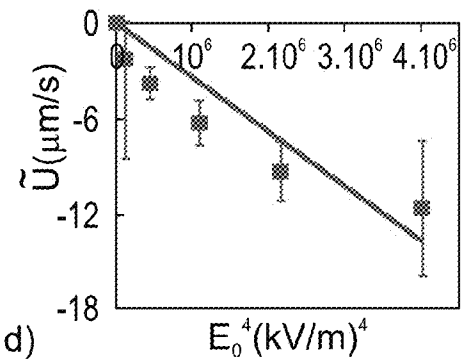
Figure 10:
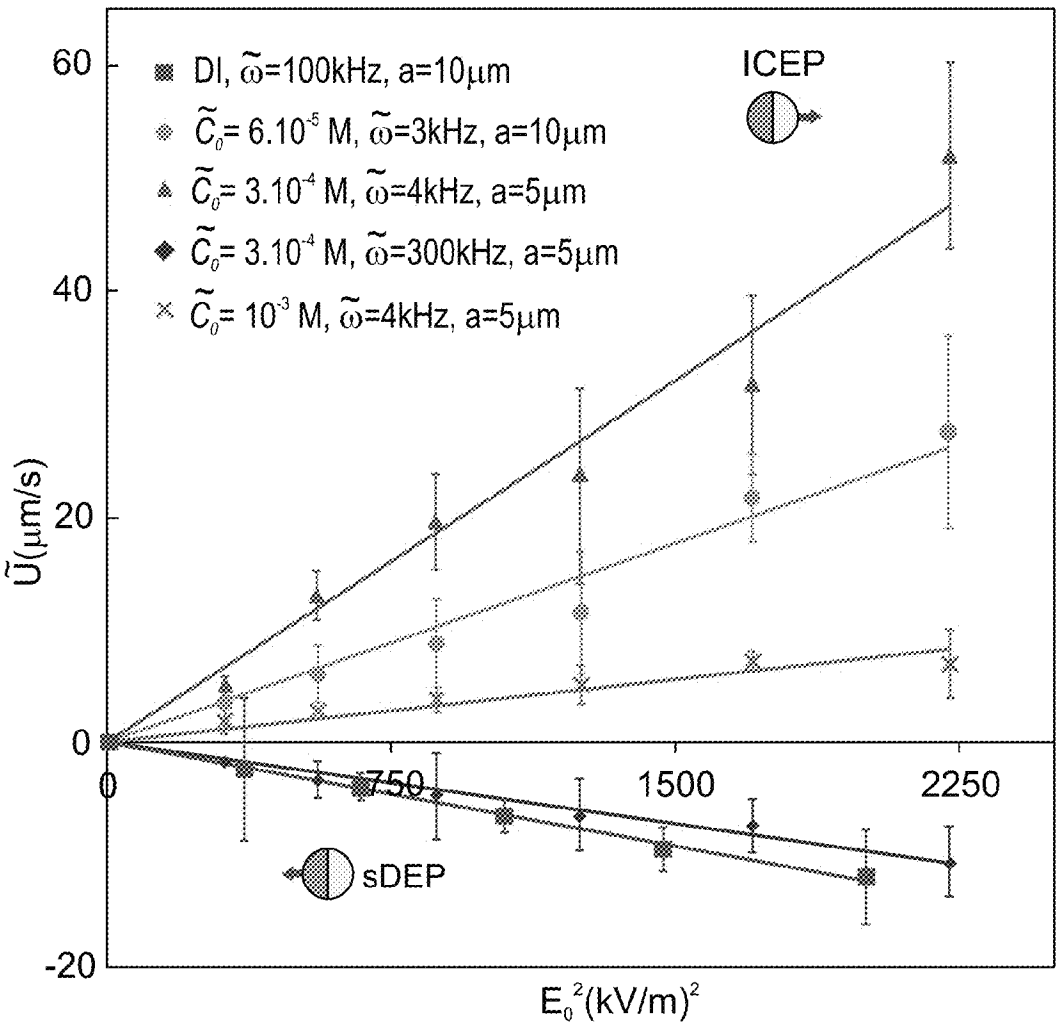
Figure 12:
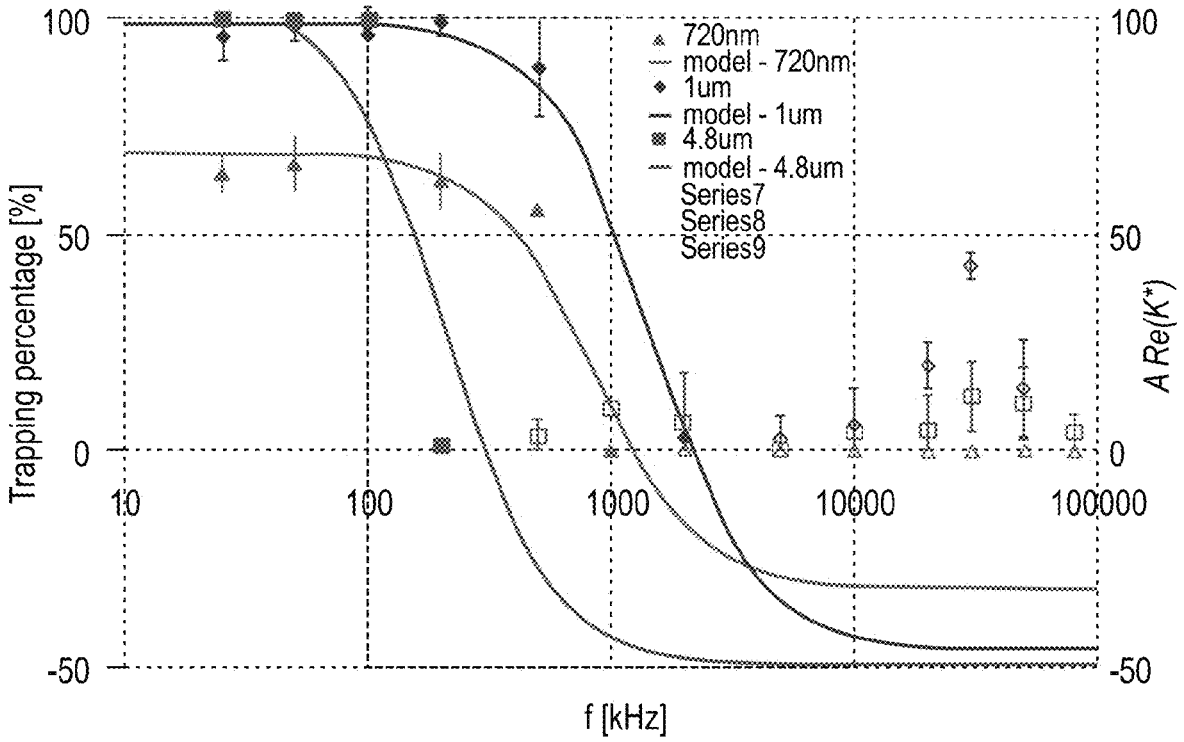
Figure 13:
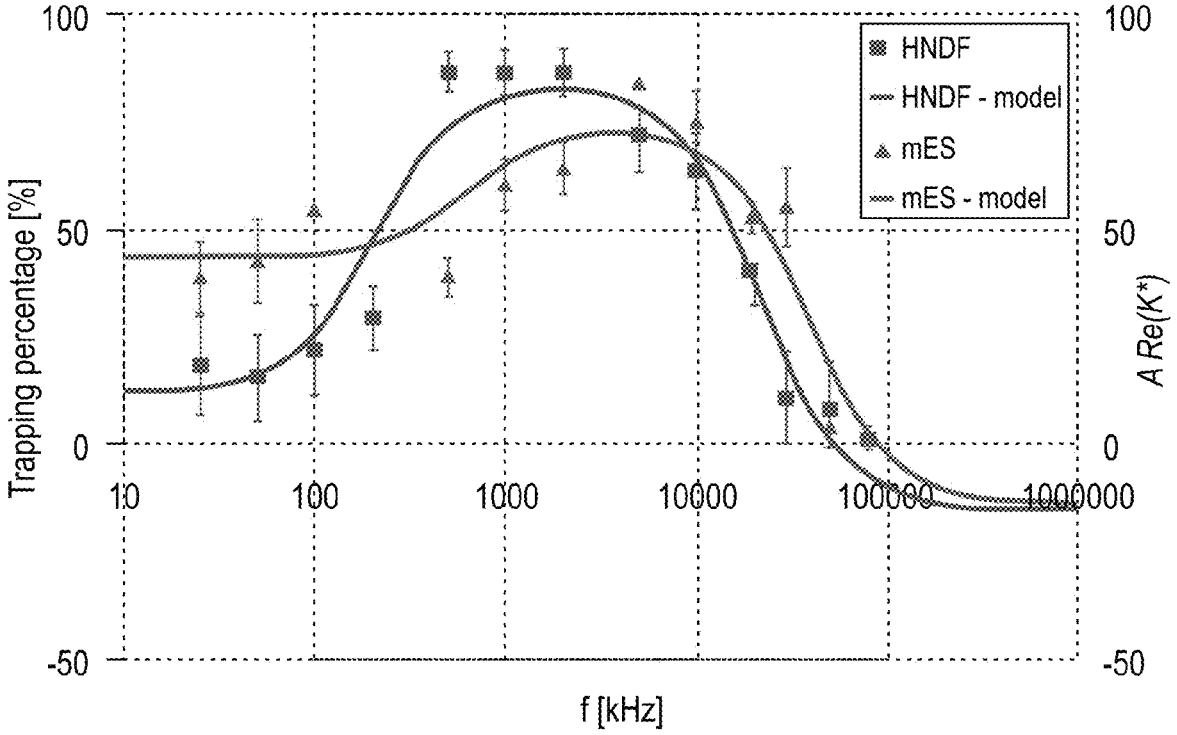
Figure 14A:
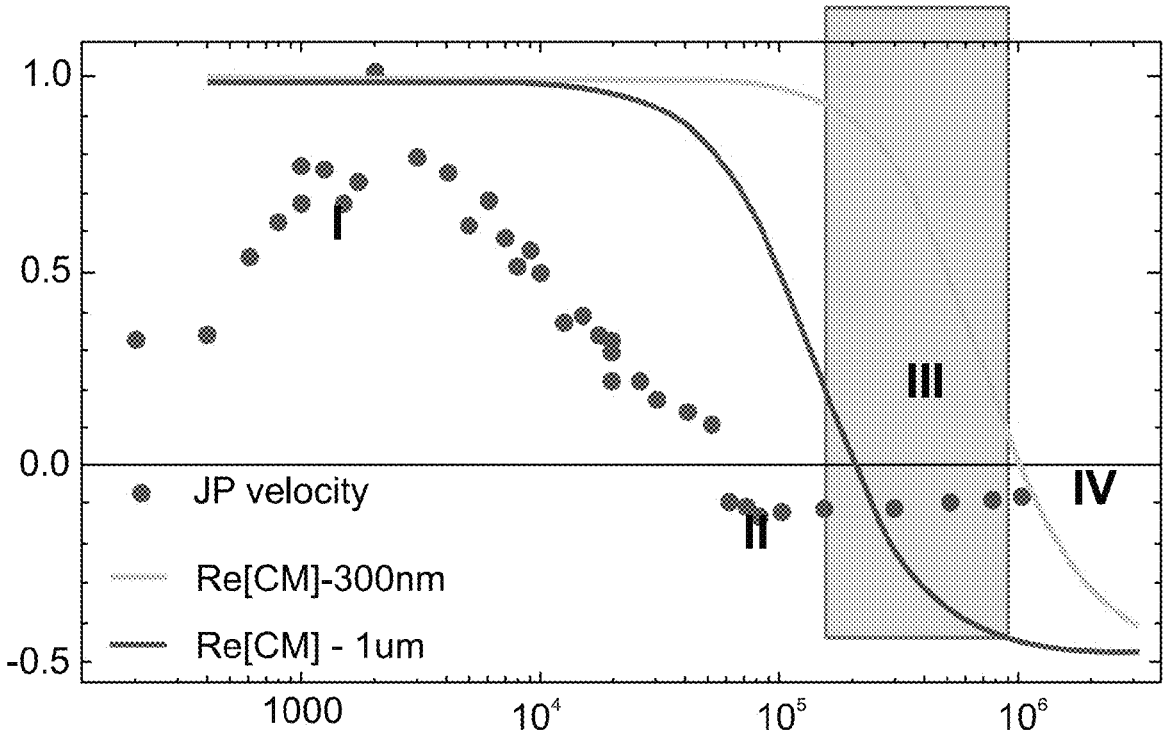
Figure 14B:
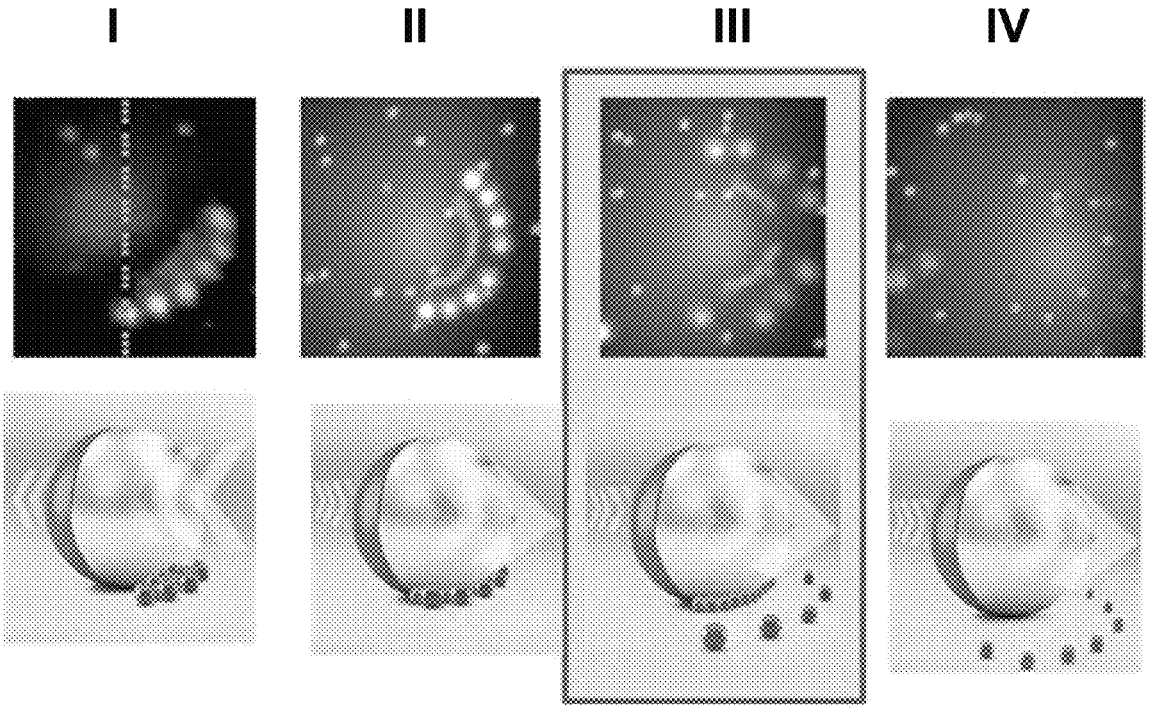
Figure 15A:
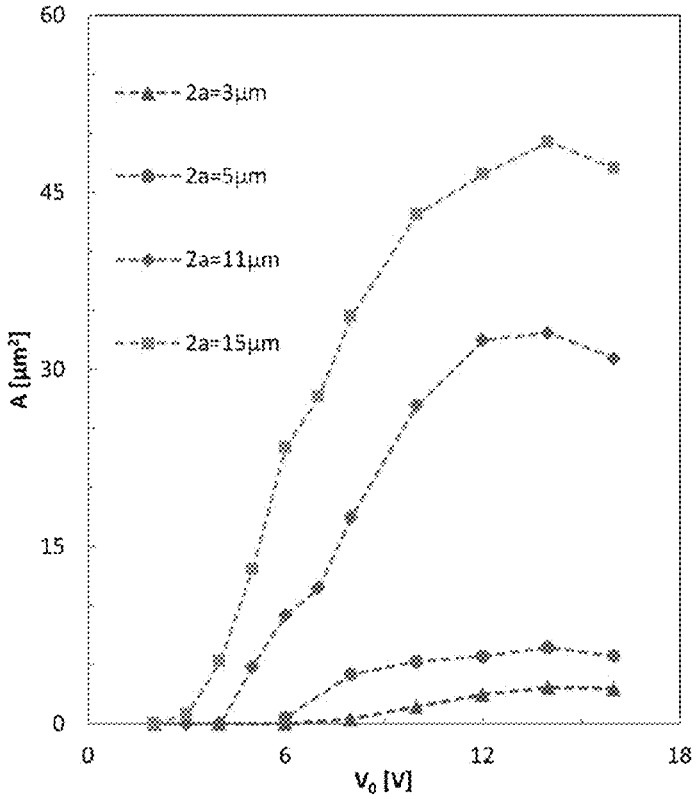
Figure 15B:
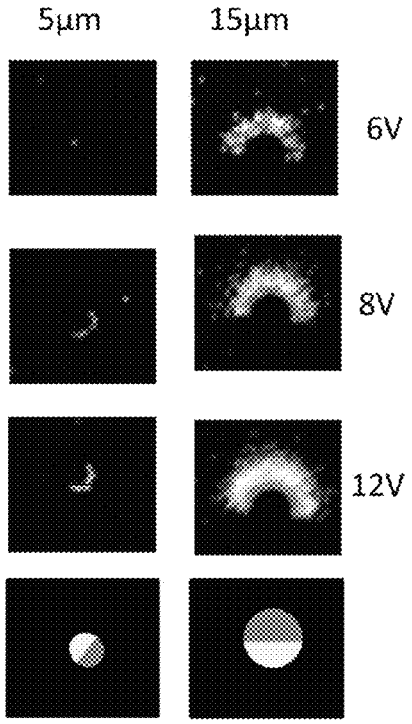

FIG. 9A is an exemplary plot of critical frequency at which Janus carrier particles begin to translate with their metallic hemisphere forward for varying electrolyte concentrations as a function of particle diameter in accordance with some exemplary embodiments of the present invention;

FIG. 9B is an exemplary plot of critical frequency at which Janus carrier particles begin to translate with their metallic hemisphere forward for varying diameters as a function of electrolyte concentrations in accordance with some exemplary embodiments of the present invention;

FIG. 10 is an exemplary plot of velocity of various Janus carrier particles at both frequencies characteristic of ICEP (positive) and self-DEP (negative) as a function of the applied field squared in accordance with some exemplary embodiments of the present invention;

FIGS. 11A, 11B and 11C are exemplary plots comparing scaling of reversed Janus carrier particle (self-DEP) velocity with the voltage of the applied field for an exemplary set of data in accordance with some exemplary embodiments of the present invention;

FIG. 12 is an exemplary plot where a theoretical CM factor (solid lines) is fitted to the trapping percentage experimental data for various particle sizes in accordance with some exemplary embodiments of the present invention;

FIG. 13 is an exemplary plot where a theoretical CM factor (solid lines) is fitted to the trapping area experimental data for various cell types in accordance with some exemplary embodiments of the present invention;

FIGS. 14A and 14B illustrates frequency domains, showing (I) JP travelling forward with its dielectric hemisphere in front under ICEP (non selective); (II) JP travelling backwards (non-selective); (III) JP travelling backwards (selective); and (IV) JP travelling backwards/stagnant with no trapped target;

FIGS. 15A-B show trapping of a single target size as a function of an applied voltage; and FIG. 16A-C show trapping of multiple target sizes as a function of applied voltage.

DESCRIPTION OF SPECIFIC EMBODIMENTS OF THE INVENTION

The present invention, in some embodiments thereof, relates to an electrical field control and, more particularly, but not exclusively, to a device and method which can trap target particles by dielectrophoresis, transport target particles by dielectrophoresis, and/or alter electric field gradient within a chamber.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

According to some embodiments of the present invention, a uniform oscillatory electric field is applied across a micro-fluidic chamber externally and frequency of the applied field is manipulated to induce desired gradients in the field adjacent to the carrier particles suspended in the chamber, e.g. between the carrier particles and an adjacent conducting wall of the micro-fluidic chamber. Optionally, the carrier particle is, for example a doublet from with two Janus particles (or other complex geometry carrier particle), and the desired gradients in the field adjacent to the carrier particles suspended in the chamber may also be formed between the two Janus particles. The latter may apply for other complex carrier geometries and the Janus particle doublet is one example. According to some embodiments of the present invention, dynamic control of frequency and amplitude of the external electric field may provide for controlling trapping and releasing of target particles with the carrier particles without relying on other physical mechanisms. In some exemplary embodiments, dynamic control of the frequency also provides for controlling transportation of the target particles with the carrier particles.

In some exemplary embodiments, single polarizable particles or structures formed from multiple particles are placed in specific locations within the chamber so that the spatio-temporal distribution of the electric field is controlled by the interaction between the particles and the external electric field. In these embodiments, it is not necessary to employ dielectrophoresis or to manipulate or trap target particles.

In some exemplary embodiments, the carrier particle may be symmetric and transport of the particle may be induced by an external driving force other than the electric field gradient. Optionally, adding magnetic functionalization e.g. substituting the partial metallic coating of the particles with magnetic coating or using a carrier particle with a magnetic core enables controlling transport based on an external magnetic field in conjunction with the applied electric field. Optionally, other driving forces may be applied for transport, e.g. DC electric field, pressure field, an optical driving force, or a mechanical driving force.

In other exemplary embodiments, the carrier particle is a symmetry broken particle. The symmetry broken particle may have symmetry broken geometric properties, e.g. particle doublet or symmetry broken electrical properties, e.g. a Janus particle. According to some embodiments of the present invention, the symmetry broken particle is also operated as a transport vehicle. The propulsion mechanism is induced by the localized symmetry breaking and is based on either induced-charge electro-phoresis (ICEP) or self-DEP (s-DEP) depending on frequency of the externally applied electric field.

Self-DEP as used herein refers to a propulsion mechanism in which the driving gradient in the electric field for mobilizing the carrier particle is self-induced by proximity of the carrier particle to a conducting channel wall. According to some exemplary embodiments, self-DEP is induced by applying an oscillatory electric field with frequency above a pre-defined critical frequency. According to some exemplary embodiments, the critical frequency depends on the electrolyte concentration and particle radius. Optionally, ICEP may be used also to free stuck particles from the substrate, after which the frequency may be increased to induce transportation by s-DEP.

In some exemplary embodiments, when the symmetry broken carrier particle is a metallodielectric Janus particle, self-DEP may be distinguished from ICEP by a switching of direction of the carrier particle. Under ICEP, the carrier particle typically travels with its dielectric hemisphere forwards due to stronger ICEO around the metallic hemisphere. Field gradients beneath the metallic hemisphere typically drive the carrier particle in the direction of its metallic end. In some exemplary embodiments, a critical frequency at which a metallodielectric Janus particle switches direction represents a point just after its dipolophoretic (DIP) velocity equals zero. The term DIP velocity as used herein refers to summation of the generally opposing DEP and ICEP velocities that operate on the carrier particle at lower frequencies.

Optionally, the carrier particles, e.g. symmetrical or symmetric broken particles may be functionalized with molecular probes to enhance accumulation and selective trapping via hybridization of target biomolecules.

According to some exemplary embodiments there is a frequency range e.g. ~100 KHz for the specific combination of 300 nm polystyrene target particles and 15 μm Janus particle, that enables trapping target particles due to positive DEP (p-DEP) and also to transport the target particles based on self-DEP when symmetry broken particles are used. According to some exemplary embodiments, target particles that have been trapped due to p-DEP may be released on demand by switching frequency of the external electric field to align with a negative DEP (n-DEP) response for the target particles. The crossover frequency (COF) for the transition from p-DEP and n-DEP typically depends on the specifics of the target particle, e.g. dielectric particle, cell, or biomolecule and the solution. For example dielectric particles may commonly exhibit a single COF and shift from p-DEP to n-DEP behavior with increasing frequency. In contrast, biological cells, which are more complex entities commonly exhibit two COFs. Control of the frequency may be used for selective sorting and transport. For example if the driving frequency with the p-DEP response of the target and n-DEP of any other contaminants, only the former will adhere to the particle.

In some exemplary embodiments, taking dielectric target particles that exhibit a p-DEP to n-DEP transition with increasing frequency as an example, frequencies significantly above a frequency that induces p-DEP for target particles (and below the frequency the COF frequency that shifts to a n-DEP behavior of the target particles) is applied for a defined time period to enhance trapping of the target particles and then the frequency is reduced (within a range of p-DEP) to enhance mobilization of the carrier particle while the target particles are still trapped. In some exemplary embodiments, the carrier particles tend to mobilize at a faster rate at the lower frequency range for self-DEP, e.g. frequencies around 100 KHz. In some exemplary embodiments, an applied voltage is controlled, e.g. increased to increase trapping.

Optionally, even lower frequencies, e.g. DC to an order of magnitude of 10 KHz, may also be applied to trap and concentrate target particles based on a combination of DEP, electro-hydro-dynamic flow and induced-charge electro-osmotic flow (ICEO).

Exemplary, target particles include colloids, polymers, metallics, biomolecules, and cells. Optionally, the device and method described herein may be applied to separation and/or cleaning and may be used as an immunoassay platform. The device and method described herein may be applied to solid carriers as well as particles that are not encapsulated within droplets.

Reference is now made to FIGS. 1A and 1B showing a schematic and accompanying microscope image depicting trapping with a homogenous particle and trapping with a Janus particle respectively in accordance with some exemplary embodiments of the present invention. According to some exemplary embodiments, gradients 20 in the electric field 'E' (represented by the color scale) are generated by a homogenous carrier particle 80 formed for example from gold (Au) near a conducting wall of a micro-fluidic chamber are typically symmetric. Typically, target particles 200 suspended in a solution with particle 80 may be trapped around carrier particle 80 in a symmetric manner. A trapping pattern around carrier particle 80 typically corresponds to gradient pattern 20 which is also symmetric with respect to geometry of particle 80. According to some exemplary embodiments, a metallodielectric Janus particle 100 includes a metal, e.g. Au hemisphere 102 and a dielectric, e.g. polystyrene (Ps) hemisphere 104. Typically, when a transition plane of the particle 100 is aligned electric field 'E', gradient 25 occurs in a vicinity of metal hemisphere 102 and target particles 200 are trapped on metal hemisphere 102 due to the induced gradient.

FIG. 1C is a schematic illustration of a mobile microelectrode, according to some embodiments of the present invention. In these embodiments particles (e.g., Janus spheres) serves as microelectrodes and the spatio-temporal distribution of the electric field is controlled by the interaction between the polarizable surfaces of the particles and the electric field. The polarizable surfaces induce local gradients at the vicinity of the particles such that the spatial distribution of the field gradient is varied by manipulating the position of the particles.

Figure 2:
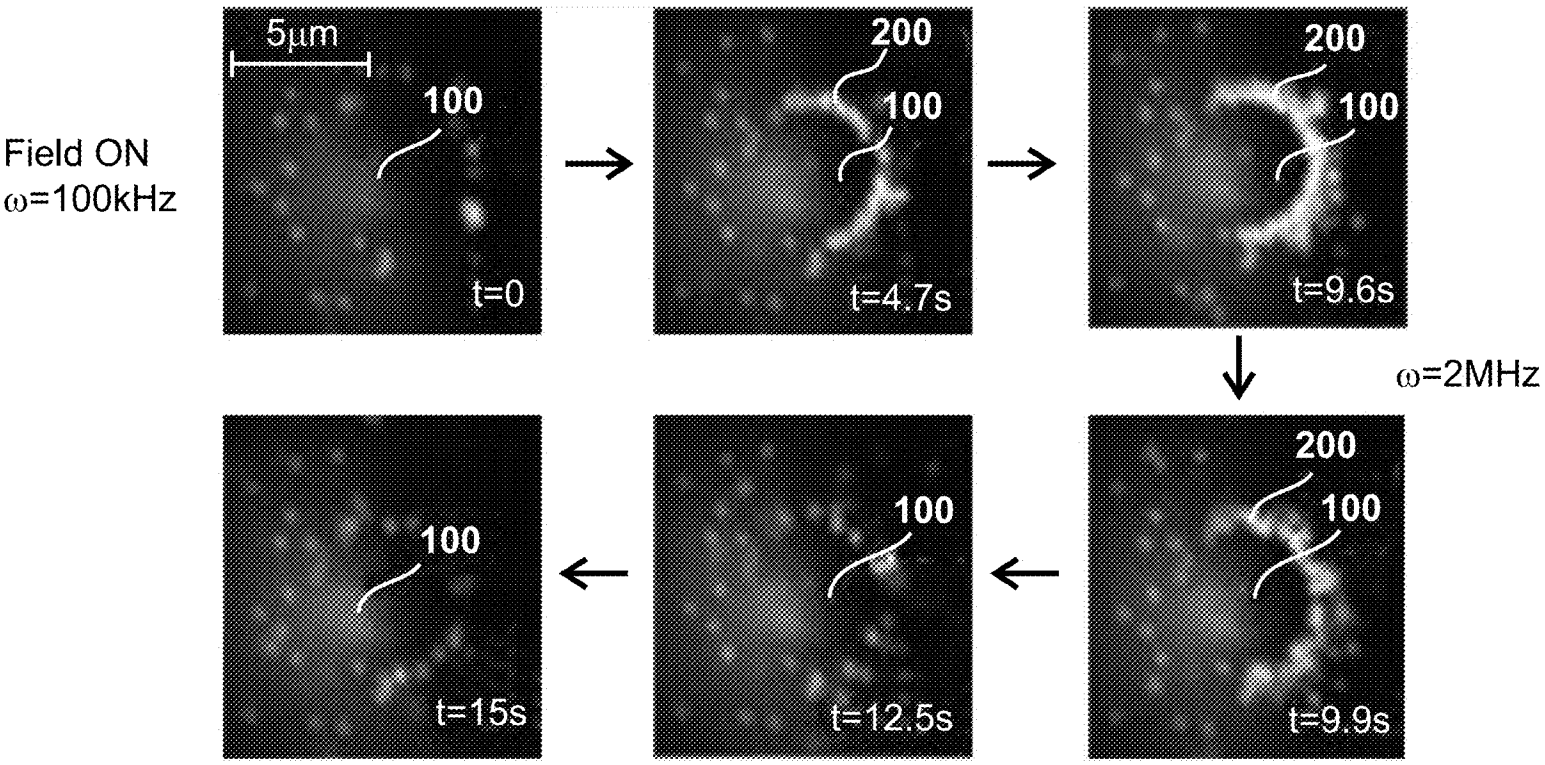

Reference is now made to FIG. 2 showing an array of microscope images captured consecutively and depicting trapping and subsequent releasing of target particles in accordance with some exemplary embodiments of the present invention. In some exemplary embodiments, a 100 KHz electric field induces a p-DEP that progressive attract target particles 200 to metal hemisphere of particle 100 over time, e.g. t=0 to t=9.6 seconds. In some exemplary embodiments, release of target particles 200 may be released from particle 100 on demand by increasing the frequency of the electric field above a frequency associated with n-DEP for target particle 200 (t=9.9 second to t=15 seconds). Optionally, increasing frequency of the electric field to 2 MHz induces n-DEP in target particles 200 that are 300 nm in diameter. Typically, a similar method may be applied for trapping and releasing target particles on homogenous particle 80. Frequencies that induce each of p-DEP and n-DEP on target particles 200 typically depend on size and composition of target particles and properties of the solution in which the particles are suspended and may be pre-determined.

Figure 3A:
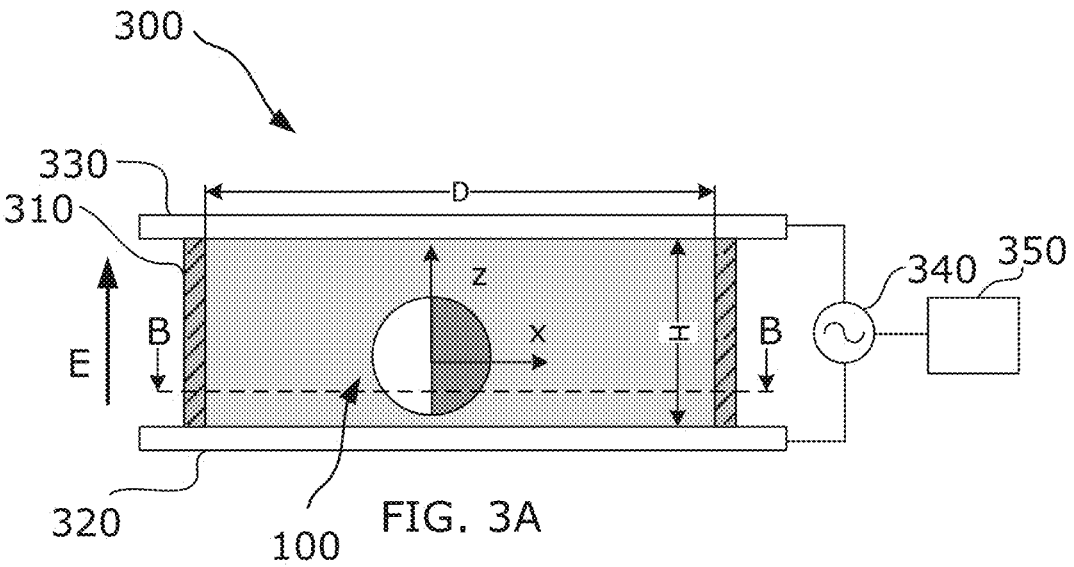
Figure 3B:
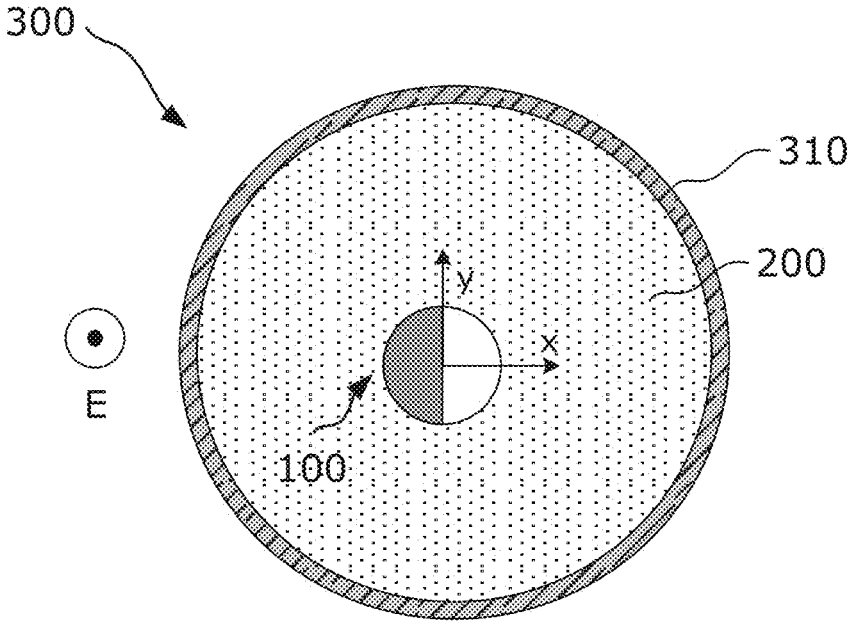

Reference is now made to FIGS. 3A and 3B showing a simplified schematic side and cross-section view respectively of a micro-fluidic chamber consisting of conducting channel walls and including a carrier particle for trapping and transporting target particles in accordance with some exemplary embodiments of the present invention. According to some exemplary embodiments, the DEP device 300 includes a micro-fluidic chamber 310 filled with a solution that contains target particles 200. The solution may be de-ionized water or electrolyte. The solution may optionally also include other elements or contaminants from which the target particles are to be separated. Optionally, micro-fluidic chamber 310 is a reservoir that is optionally rounded. In some exemplary embodiments, chamber 310 includes a first electrode 320 on a bottom of chamber 310, e.g. the cover slip and a second electrode 330 on the top of chamber 310, e.g. on a slide. In some exemplary embodiments, each of first electrode 320 and second electrode 320 are formed with indium tin oxide (ITO). Each of first electrode 320 and second electrode 330 are connected to an AC source 340 and controller 350 for generating a desired uniform electric field across chamber 310. Typically, AC source 340 and controller 350 are integrated into a single unit. Typically, chamber 310 is sandwiched between first electrode 320 and second electrode 330 so that a direction of the electric field 'E' is along a direction of height 'H' of chamber 110 (Z-direction). Typically, chamber 110 is formed from a non-conductive material, e.g. silicon.

According to some exemplary embodiments, DEP device 300 includes one or more carrier particles 100 each of which are configured to both trap and transport target particles suspended in chamber 310 when exposed to a uniform electric field 'E' established between first electrode 320 and second electrode 330. In some exemplary embodiments, particle 100 is a symmetry broken particle, e.g. particle doublet or Janus particle and its proximity to at least one of first electrode 320 and second electrode 330 induces a local gradient in electric field 'E' that drives movement of the particles 100. In some exemplary embodiments, diameter of particles 100 is defined in relation to height of chamber 310 so that a desired local gradient may be established.

In one exemplary embodiment, particle 100 is a Janus particle with a diameter of 15 μm and height 'H' of chamber 310 or distance between first electrode 320 and second electrode 330 may be for example 120 μm. Typically movement of particle 100 due to the induced local gradient in the electric field 'E' is along an X-Y plane. Optionally, a diameter 'D' of chamber 310 is for example 2 mm in diameter. In some exemplary embodiments, the Janus particle may be a sphere formed from Ps with a hemisphere of the sphere coated with 10 nm Cr and then 20 nm of Au. Alternatively, the carrier particle 100 may be formed from Ps with portion of the sphere coated with 10 nm Cr and then 20 nm of Au, e.g. stripes or asymmetric portion of the sphere.

According to some embodiments of the present invention controller 350 controls the trapping, transporting and releasing the target particles by adjusting frequency of AC source 340. The frequencies applied for trapping, transporting and releasing are typically defined based on properties of target particles, properties of particle 100 and properties of the solution contained in chamber 310.

Alternatively, carrier particle 100 may be a replaced by homogenous particle, e.g. a sphere from Ps that is fully coated with Au and chamber 310. In some exemplary embodiments, trapping and releasing of target particles on the homogenous carrier particle may be controlled by controller 350 which alters the AC frequency of AC source 340. In some exemplary embodiments, an additional mechanism of transportation may be associated with an additional physical mechanism, e.g. magnetic force may also be controlled by controller 350 for transporting the homogenous carrier particle. Optionally, a coil for inducing a magnetic field may be associated with device 300 and may be used to magnetically drive mobilization of the homogenous particles.

Figure 3C:
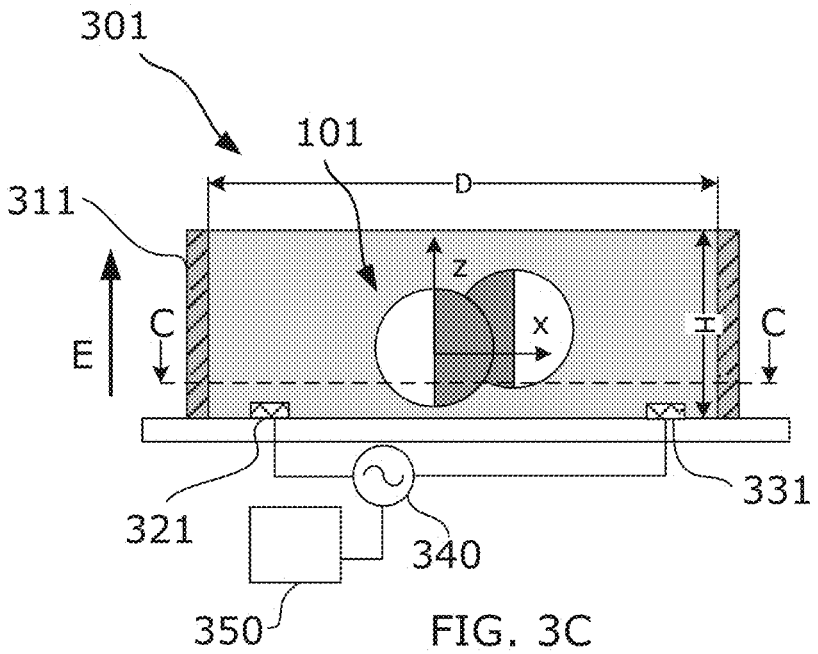
Figure 3D:
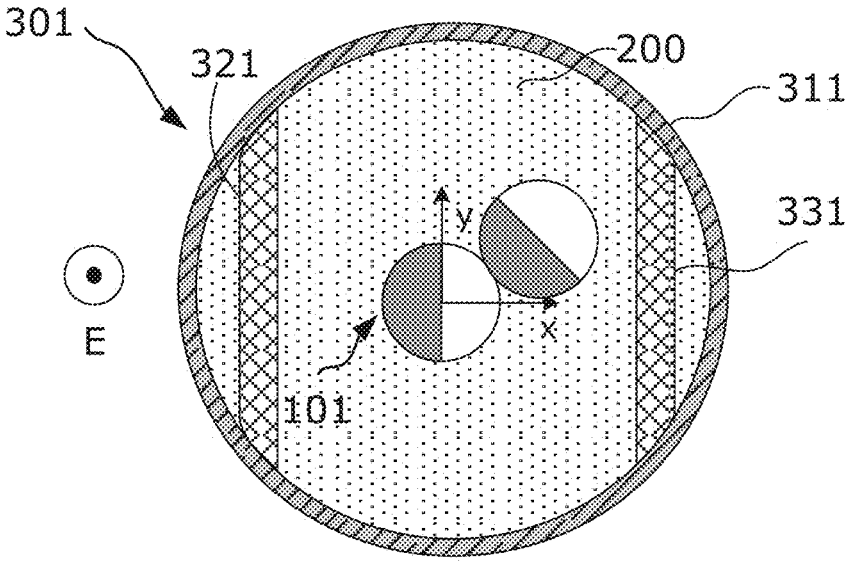

Reference is now made to FIGS. 3C and 3D showing a simplified schematic side and cross-section view respectively of a micro-fluidic chamber including insulating channel walls, electrodes embedded on the substrate and a complex geometry carrier particle for trapping and transporting target particles in accordance with some exemplary embodiments of the present invention According to some exemplary embodiments, the DEP device 301 includes a micro-fluidic chamber 311 filled with a solution that contains target particles 200. The solution may be de-ionized water or electrolyte. The solution may optionally also include other elements or contaminants from which the target particles are to be separated. Optionally, micro-fluidic chamber 311 is a reservoir that is optionally rounded. In some exemplary embodiments, chamber 311 includes a first electrode 321 and second electrode 331 both positioned on either the bottom or top slide of the chamber 311. Each of first electrode 321 and second electrode 331 are connected to an AC source 340 and controller 350 for generating a desired uniform electric field across chamber 311 and parallel to the cover slip. In some exemplary embodiments, chamber 311 may be used with a complex carrier particle 101 for trapping and transporting target particles.

Figures 4, 5A, 5B, 5C, 5D, 5E:
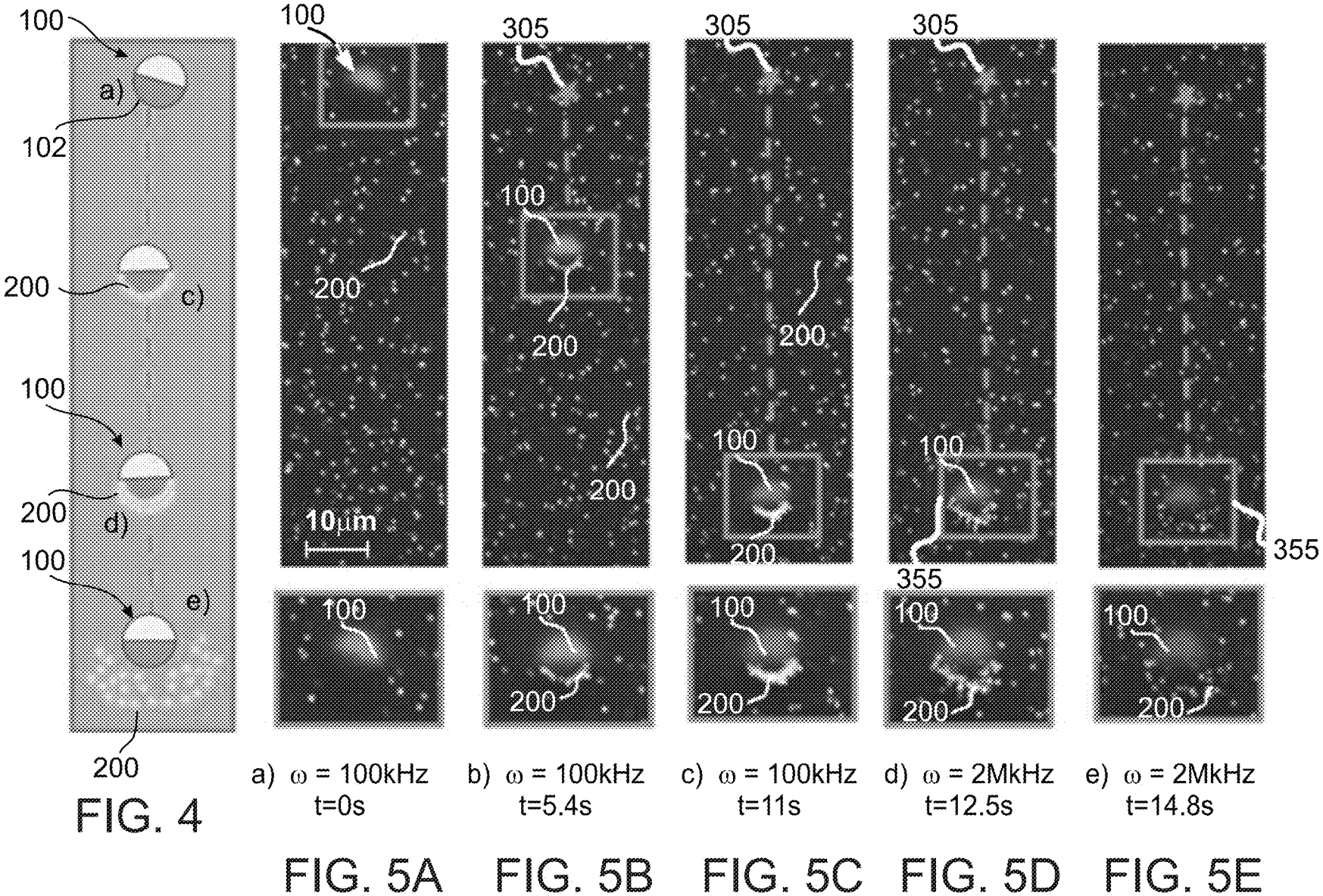

Reference is now made to FIG. 4 showing a simplified schematic drawing depicting trapping, transporting and release of exemplary target particles and to FIGS. 5A, 5B, 5C, 5D and 5E showing an array of exemplary microscope images captured over consecutive time periods that depict trapping and transporting of target particles under an electric field of alternating at frequency 100 KHz and subsequent release of the target particles under and electric field that alternates at frequency 2 MHZ, all in accordance with some exemplary embodiments of the present invention. The microscope images showing in FIGS. 5A, 5B, 5C, 5D and 5E depict an exemplary Janus particle 100 trapping, transporting and then releasing target particles 200. In some exemplary embodiments, trapping is controlled by p-DEP, transporting is controlled by either s-DEP or ICEP and release is controlled by n-DEP. The Janus particle 100 imaged is an exemplary Au-Ps particle with an exemplary diameter of 15 μm and target particles 200 imaged are exemplary colloids with an exemplary diameter of 300 nm.

According to some exemplary embodiments, at t=0 seconds, an electric field with first frequency defined for inducing p-DEP, e.g. 100 KHz for target particle 200 is applied across chamber 310. In some exemplary embodiments, over time the first frequency induces localized electric field gradients around particle 100 that attract target particles 200 (FIG. 4: a), c), d) and FIGS. 5A, 5B, 5C, 5D). In some exemplary embodiments, the first frequency, e.g. 100 KHz (FIG. 4: c) and FIGS. 5B, 5C) is also above the critical frequency for activating self-DEP and particle 100 may trap target particles while moving toward walls of the micro-fluidic chamber. In some exemplary embodiments, when frequency of field is raised above the critical frequency for inducing self-DEP and particle 100 is metallodielectric (Au-Ps) Janus particle, particle 100 will translate with its metallic hemisphere 102 in the direction of movement.

In some exemplary embodiments, the same frequency is maintained to mobilize Janus particle 100 via self-DEP to a desired location while target particles 200 that have been trapped remain attached to Janus particle 100. Optionally, Janus particle 100 may be mobilized from a start location 305 to a target location 355 over a plurality of seconds or minutes, e.g. 11 seconds (FIG. 5C). During mobilization, target particles 200 may continue to accumulate on Janus particle 100 via p-DEP (FIG. 4: c), d), FIGS. 5B and 5C). Alternatively, a first frequency may be applied to attract target particles 200 via p-DEP and a second frequency that is typically lower than the first frequency but above a frequency that initiates self-DEP may be applied to rapidly mobilize particle 100 while maintaining the attached target particles 200 on particle 100.

In some exemplary embodiments, when Janus particle 100 reaches a desired location, e.g. after a defined time period, frequency of the AC signal generating the uniform electric field is increased to a level that induces n-DEP on particles 200, e.g. frequency is increased to 2 MHz. Reaching n-DEP for target particle 200 provides for releasing target particle 200 from Janus particle 100 (FIG. 4: t=t4 and FIGS. 5D and 5E). Mobilization of particle 100 may typically slow down at frequencies around 1 MHz and more. According to some exemplary embodiments, location at which target particles 200 are released or concentrated may be dynamically controlled with controller 150 by altering frequency of the AC signal in a stepwise manner at defined time periods.

Figure 6A:
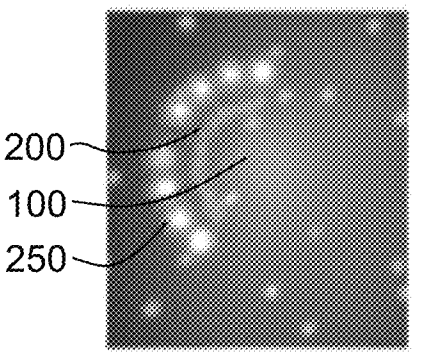
Figure 6A:
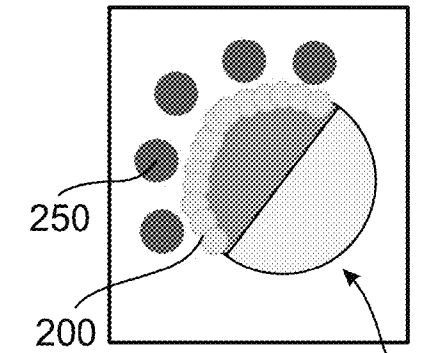
Figure 6B:
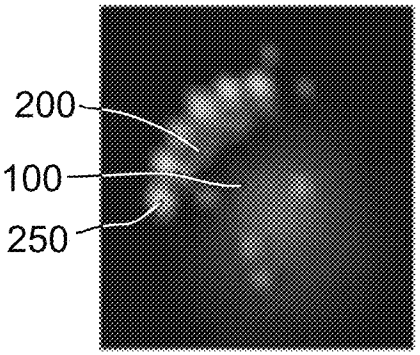
Figure 6B:
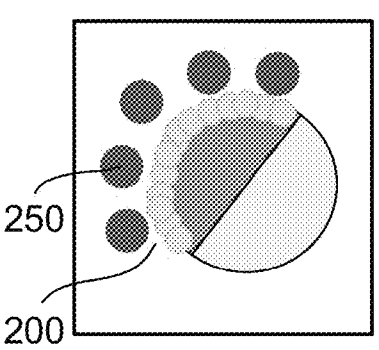
Figure 6C:
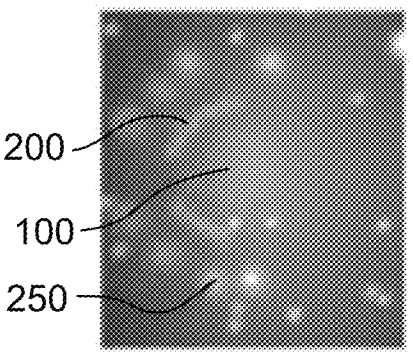
Figure 6C:
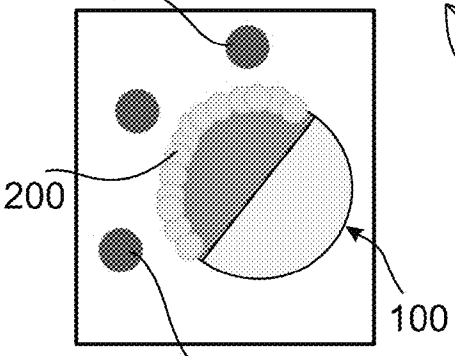
Figure 6D:
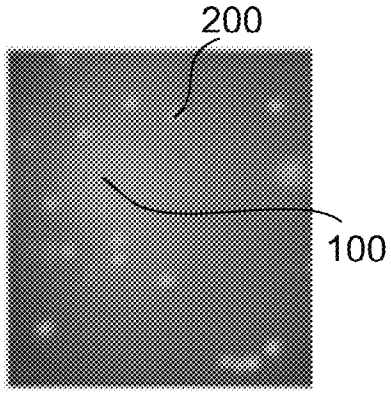
Figure 6D:
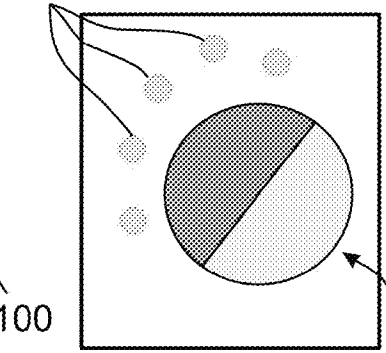

Reference is now made to FIGS. 6A, 6B, 6C and 6D showing simplified schematic drawings with accompanying exemplary microscope images that depict selective trapping and release over four exemplary consecutive steps in accordance with some exemplary embodiments of the present invention. In some exemplary embodiments, control of the frequency is used to selectively sort target particles. In some exemplary embodiments, a frequency applied to mobilize a particle 100 may correspond to p-DEP range for target particle 200 as well as additional contaminant particles 250 (FIG. 6A). For example, when applying a frequency of 100 KHz, both particles 200 and particles 250 may experience p-DEP and may be trapped on particle 100. In some exemplary embodiments, a relatively low frequency may be applied, e.g. 1 KHz (FIG. 6B) over a defined time period to transport the particles based on ICEP. In some exemplary embodiments, the applied frequency may be applied to trap and transport the particles to a desired location. In some exemplary embodiments, the frequency is adjusted at a defined location or after a defined time period so as to maintain the p-DEP response of target particles 200 while reaching an n-DEP of other contaminants 250 (FIG. 6C). In the example shown, target particles 200 are 300 nm polystyrene particles and contaminants 250 are 1 um particles. The Janus particle 100 is a 15 μm metallodielectric particle. At frequency of 100 KHz both particles 200 and particles 250 have a p-DEP and are attracted to particle 100. At frequency 750 KHz, particles 250 are rejected while particles 200 are maintained on particle 160. At frequency 2 MHz, particles 200 may be released (FIG. 6D).

In some exemplary embodiments, a symmetrical carrier particle is used instead of a Janus particle. In such embodiments, selective trapping is performed by adjusting the frequencies to correspond to p-DEP for target particles and n-DEP for contaminants and mobilization to a desired release site is controlled by alternate driving forces. Optionally, the alternate driving force is a magnetic driving force that attracts a magnetic coating or core on particles 100.

Figure 7:
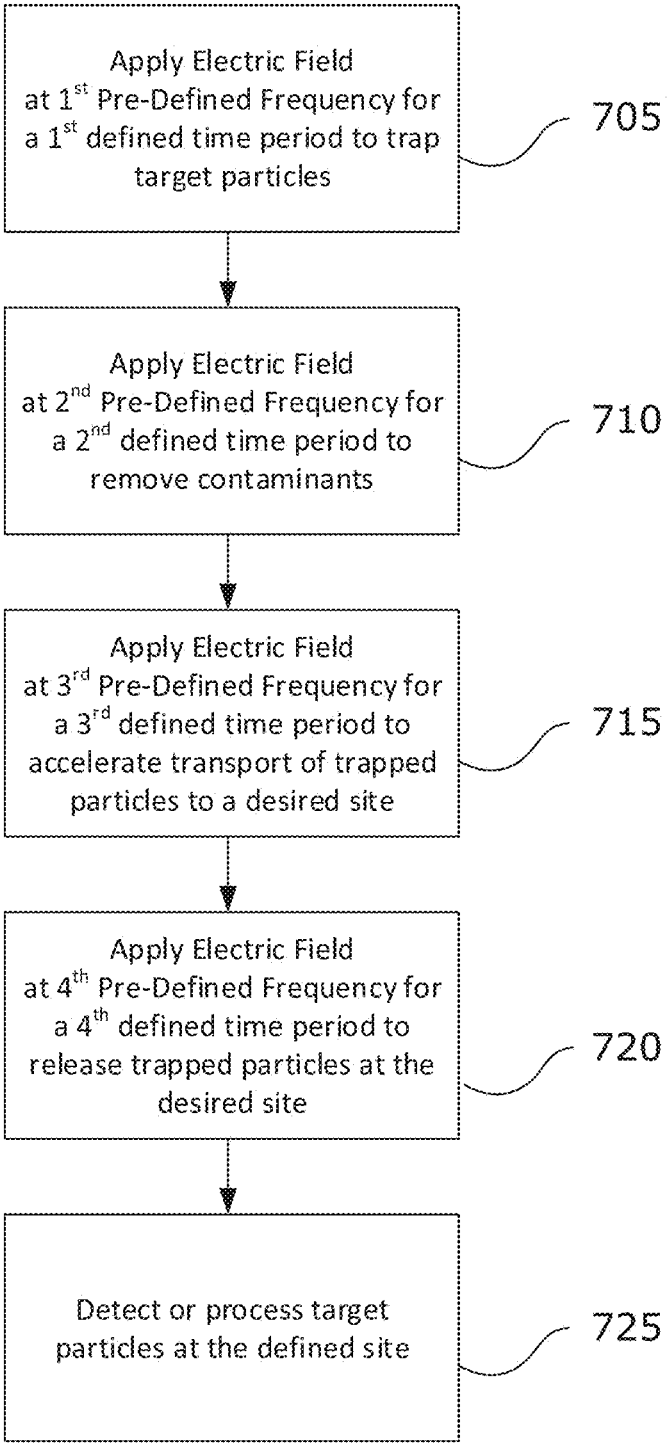

Reference is now made to FIG. 7 showing a simplified flow chart of an exemplary method for dynamically controlling DEP in accordance with some exemplary embodiments of the present invention. According to some embodiments of the present invention, a pair of electrodes applies an electric field across a micro-fluidic chamber containing carrier particles suspended in a solution that also contains target particles. According to some embodiments of the present invention, a first frequency of the applied electric field is selected to induce p-DEP for trapping target particles in the solution. Typically, the $1^{st}$ frequency is pre-defined based on known properties of the target particles as well as known properties of the solution containing the target particles. Typically, the target particles are accumulated over time and a defined time period is selected to allow the target particles to accumulate on the carrier particles. In some exemplary embodiments, the first frequency is selected to be above a critical frequency for inducing self-DEP on symmetry broken particles, and the carrier particles are mobilized as they trap the target particles. (block 705)

Optionally, a frequency of the electric field is altered to a second pre-defined frequency to remove contaminants that may also be attracted to the carrier particles. Typically, the contaminants may be removed by selecting a frequency that induces n-DEP on the contaminants and p-DEP on the target particles. (block 710)

Optionally, a frequency of the electric field is altered to a third pre-defined frequency to accelerate mobilization of the carrier particles together with the target particles that have been trapped. Optionally the frequency is above the critical frequency for inducing self-DEP on the carrier particles. Typically, velocity of the carrier particle tends to decrease with an increase in frequency. Optionally, higher frequencies are applied to accelerate trapping and then lower frequencies are applied to mobilize, the carrier particle together with the trapped particles using an ICEP mechanism. (block 715)

Optionally, once the trapping duration is completed and/or once the carrier particle has reached a desired site, a frequency of the electric field is altered to a forth pre-defined frequency to release the target particles. Typically, the forth pre-defined frequency is a frequency that induces n-DEP on the target particles. (block 720)

In some exemplary embodiments, release of the target particles facilitates detection or secondary processing of the target particles (block 725).

According to some exemplary embodiments, frequencies for inducing p-DEP, n-DEP and self-DEP and time periods required to obtain a desired accumulation or reach a desired site are pre-determined based on known properties of the device, known properties of the target particles, solution and empirical data.

According to some exemplary embodiments, there is provided a method of controlling spatio-temporal distribution of an electric field in a microfluidic chamber. The method comprises distributing symmetry broken structures in the microfluidic chamber, applying an electric field across the microfluidic chamber, and controlling the electric field and the locations of the structures, such that electric field gradients induced adjacent to the structures control the spatio-temporal distribution of the electric field in the microfluidic chamber.

In some embodiments of the present invention the symmetry broken structures comprise symmetry broken particles. In some embodiments of the present invention the symmetry broken structures comprise multi-particle structure. In some embodiments of the present invention the symmetry broken particles comprise Janus particles.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Various embodiments and aspects of the present invention as delineated hereinabove and as claimed in the claims section below find experimental support in the following examples.

EXAMPLES

Reference is now made to the following examples, which together with the above descriptions illustrate some embodiments of the invention in a non limiting fashion.

Figure 8B:
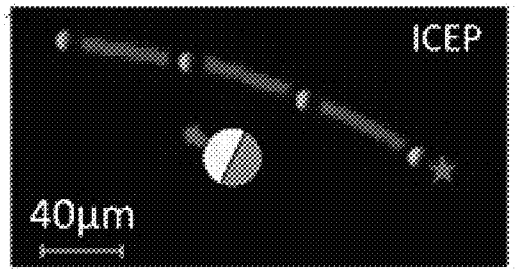
Figure 8C:
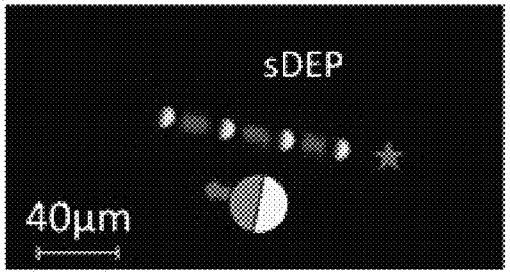
Figure 8A:
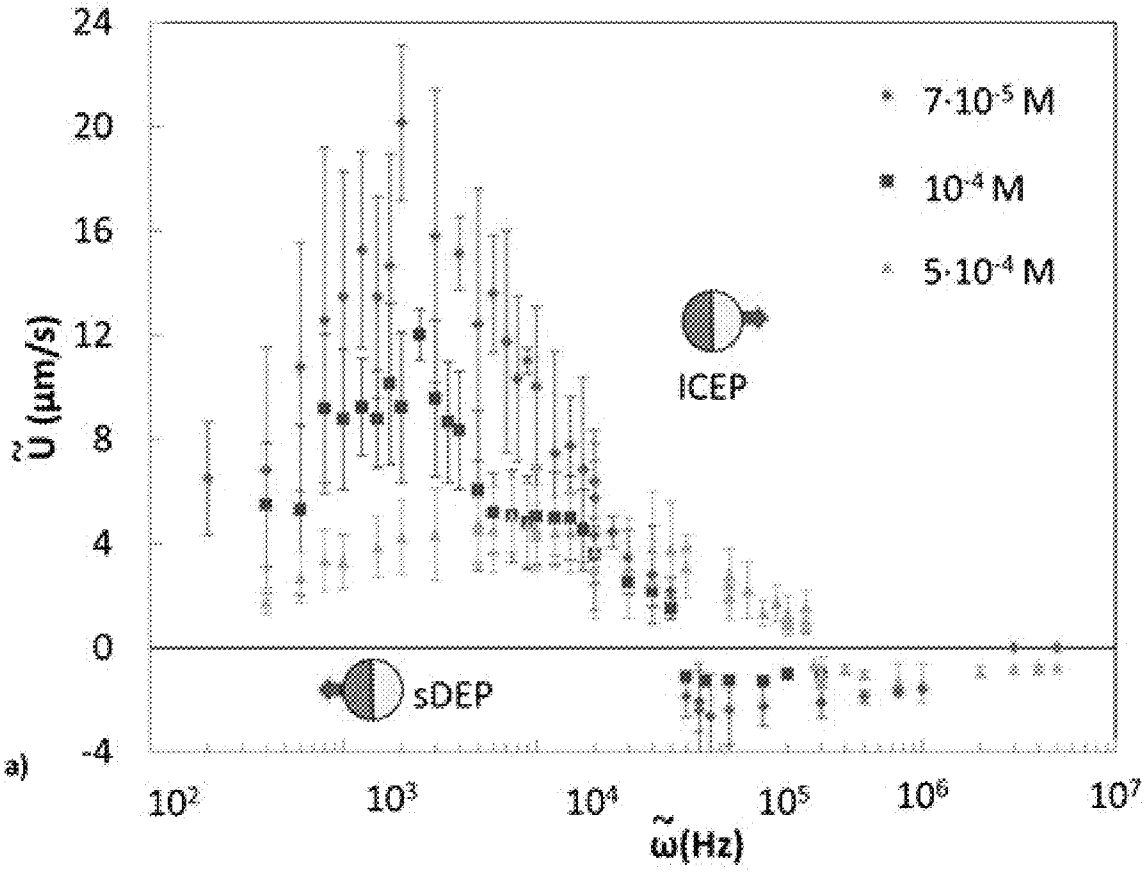

FIG. 8A is an exemplary graph showing frequency dispersion of 5 μm Janus carrier particles suspended in KCl electrolyte of varying concentration in accordance with some exemplary embodiments of the present invention. For convenience, Au-Ps Janus particles translating with Ps hemisphere forwards have been designated as positive while Au hemisphere forwards is negative. Particle velocities for the frequency dispersion were extracted by tracking particle displacement and averaging the velocity over the number of mobile particles, where the error bars represent the standard deviation of the average velocity. Applied voltage is 5Vp-p. Error bars indicate the standard deviation of the average velocity of multiple particles in the same experimental cell. FIGS. 8B and 8C are superimposed microscope images showing a path of 15 μm Janus carrier particles in $5\times10^{-4}$ M KCl at 50 KHz and at 1 MHz respectively in accordance with some exemplary embodiments of the present invention. At 50 KHz forward ICEP motion is shown to dominate while at 1 MHz backwards DEP motion is shown to dominate.

FIG. 9A is an exemplary plot of critical frequency at which Janus carrier particles begin to translate with their metallic hemisphere forward for varying electrolyte concentrations as a function of particle diameter and FIG. 9B is an exemplary plot of critical frequency at which Janus carrier particles begin to translate with their metallic hemisphere forward for varying diameters as a function of electrolyte concentrations both in accordance with some exemplary embodiments of the present invention. Experimental data is fit with a single fitting parameter c according to equation (1):

$$\frac{\tilde{\omega}_{cr}}{\tilde{C}_o^{3/4}\, a^{-1/2}} \cdot \frac{\gamma^{3/2}}{D_s} = c = 3\cdot 10^{-4} \qquad \text{Equation (1)}$$

Where:

$\omega_{cr}$ is critical frequency for inducing self-DEP;

$$\gamma = \left(\frac{\varepsilon_0 RT}{2F^2}\right)^{1/2}$$

where $\varepsilon_0$ is the permittivity of the medium, R is the universal gas constant, T the temperature and F is Faraday's constant is the solute permittivity;

$\check{C}_o$ is the molar concentration of the electrolyte;

a is radius of the target particle; and $D_s$ is the diffusion coefficient of the KCl electrolyte Closed symbols in the graph stand for the frequency at which the first particle was seen to translate backwards while open symbols for the frequency at which no more particles were observed to move forward.

FIG. 10 is an exemplary plot of velocity of various Janus carrier particles at both frequencies characteristic of ICEP (positive) and self-DEP (negative) as a function of the applied field squared in accordance with some exemplary embodiments of the present invention. This plot may illustrate that the velocity scales quadratically in the applied field.

FIGS. 11A, 11B and 11C are exemplary plots comparing scaling of reversed Janus carrier particle (self-DEP) velocity with the voltage of the applied field for an exemplary set of data in accordance with some exemplary embodiments of the present invention. Based on FIGS. 11A, 11B and 11C quadratic scaling may represent the best fit. Error bars indicate the standard deviation of the average velocity of multiple particles in the same experimental cell.

Reference is now made to FIG. 12 showing an exemplary plot of a theoretical CM factor (solid lines) fitted to the trapping percentage experimental data for various particle sizes in accordance with some exemplary embodiments of the present invention. Trapping percentages are presented as a function of frequency (in a logarithmic scale) for various particle sizes. As can be seen, all particles exhibited similar behavior, i.e. having a plateau of maximal trapping percentage at low frequencies beyond which, at a certain frequency threshold the trapping percentage approaches zero. This frequency threshold corresponds to the particle COF where a transition from p-DEP to n-DEP occurs. Particles undergoing n-DEP, should exhibit negligible trapping percentages. However, an unexpected result was observed at frequencies approaching the maximal n-DEP force magnitude (~1 MHz and ~10 MHz for the 4.8 μm and 1 μm particle, respectively). Most probably, this effect is the result of strong n-DEP repulsion, this time acting in a direction opposite the fluid flow in such a way that some of these particles are blocked and not able to cross the electrode array.

Reference is now made to FIG. 13 showing an exemplary plot of a theoretical CM factor (solid lines) fitted to the trapping percentage experimental data for various cell types in accordance with some exemplary embodiments of the present invention. It is observed that the maximum trapping percentage occurs at some intermediate frequency range as expected. At high frequencies, the trapping percentage vanishes due to the existence of a COF point. On the opposite low frequency range the trapping percentage levels off to some non-vanishing values. 13 This also stands in agreement with the theoretical/experimental findings according to which there is no necessity for a second COF at low frequency range, an effect that strongly depends on the membrane conductively while negligibly on the cytoplasm conductivity. In contrast, the COF occurring at higher frequencies strongly depends on the latter.

Reference is now being made to FIGS. 14A and 14B showing a graph of a Clausius-Mossotti factor as a function of the frequency (FIG. 14A) and schematic illustrations and microscope images (FIG. 14B), describing mobile particles, according to some embodiments of the present invention. FIGS. 14A and 14B demonstrate that the operation conditions can be determined by plotting the frequency dependent velocity of JP carrier (blue data points) and the real part of the Clausius-Mossotti factor of target and contaminant (yellow and red curves, respectively). Four frequency domains are observed and denoted by Roman numerals I-IV. Each frequency domain in FIG. 14A corresponds to an illustration and a microscope image in FIG. 14B. In domain I (low frequencies, e.g., less than 40,000 Hz), target and contaminant undergo pDEP (non-selective trapping) while JP propagate forward (with its dielectric hemisphere in front) under ICEP. In domain II (frequency from about 50,000 Hz to about 100,000 Hz) the Janus particle reverses the motion direction but both target and contaminant still undergo pDEP. In domain III (from about 150,000 Hz to about $10^6$ Hz), selective trapping occurs. In this domain, the target undergoes pDEP while the contaminant undergoes nDEP. In domain IV (above $10^6$ Hz) the frequency aligned with nDEP of target for release.

FIGS. 15A an 15B show a graph of an area as a function of a voltage (FIG. 15A) and microscope image (FIG. 15B) of trapped fluorescent target particles. Shown is the variation of area of trapped 300 nm fluorescent target particles with applied voltage around Janus spheres 3, 5, 11 and 15 μm in diameter. Shown on the right hand side of the figure are microscope images of trapping around Janus spheres 5 (left column) and 15 μm (right column) in diameter at for applied fields of 6, 8 and 12V with a schematic (bottom row) indicating orientation of the JP.

FIGS. 16A-C show a graph of areas of accumulated targets of varying diameter around a 15 μm Janus sphere as a function of applied voltage for varying sized targets (FIG. 16A), measured (blue diamonds) and geometrically predicted (solid blue line) minimum value of the radial coordinate $x_1$ at which targets accumulate and the measured (red symbols) maximum $x_1$ value for various applied voltages (FIG. 16B), and microscope images of 100, 300 and 720 nm targets accumulated around a 15 μm Janus sphere for applied fields ranging between 4-16V reflecting a sample of the experimental data used to determine part FIG. 16A. Experimental values for the maximum and minimum values were taken by halving the diameter of the inner and outer circles indicated in the inset of FIG. 16B respectively.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A method for dielectrophoresis (DEP), the method comprising:

by an alternating current (AC) source applying an electric field across a micro-fluidic chamber with an AC, wherein the micro-fluidic chamber contains an electrolyte-solution with suspended target particles and at least one carrier particle freely floating on or in the electrolyte-solution, wherein the electric field is uniform absent said at least one carrier particle present in the micro-fluidic chamber, and wherein said at least one carrier particle induces a gradient to said electric field;

by a controller:

selectively trapping the target particles on the at least one carrier particle based on localized gradients of the electric field induced by the carrier particle;

transporting the target particles from a first location in the micro-fluidic chamber to a second location in the micro-fluidic chamber distanced from the first location with the at least one carrier particle; and dynamically controlling the trapping and the transporting by dynamically selecting a frequency of the AC.

2. The method according to claim 1, comprising, by said controller, dynamically controlling release of said trapped target particles from said at least one carrier particle, based on said dynamic selection of said frequency of the AC.

3. The method of claim 1, wherein the trapping and the transporting are dynamically controlled based on selection of amplitude of the AC.

4. The method according to claim 1, wherein dynamically controlling the transporting is based on selecting on demand a first pre-defined frequency configured to induce self DEP (s-DEP) on the at least one carrier particle.

5. The method according to claim 1, wherein the trapping is dynamically controlled based on selection of a frequency of the AC electric field and the transporting is dynamically controlled based on an externally applied magnetic field.

6. The method according to claim 5, wherein the at least one carrier particle includes magnetic functionalization.

7. The method according to claim 6, wherein the magnetic functionalization is based on magnetic material coated on the carrier particle or a magnetic core of the carrier particle.

8. The method according to claim 1, wherein the trapping is dynamically controlled based on selection of a frequency of the AC electric field and the transporting is dynamically controlled based on an externally applied optical force.

9. The method according to claim 5, wherein the at least one carrier particle is a homogenous particle.

10. The method according to claim 1, wherein the at least one carrier particle is a symmetry broken particle.

11. The method according to claim 10, wherein the at least one carrier particle is a Janus particle.

12. The method according to claim 10, wherein the localized gradient induced is based on proximity of the particle to a conducting wall of the micro-fluidic chamber.

13. The method according to claim 10, wherein the transporting is in a direction perpendicular to the direction of the electric field.

14. The method according to claim 1, wherein the at least one carrier particle is at least one of a particle doublet, a cluster and a particle with non-spherical shape, and wherein the localized gradients induced is based on the geometric characteristics of the target particle.

15. The method according to claim 1, wherein the at least one carrier particle is functionalized with molecular biological probes.

16. The method according to claim 1, wherein dynamically controlling the trapping is based on selecting on demand a pre-defined frequency configured to induce positive DEP (p-DEP) on the target particles.

17. The method according to claim 1, wherein dynamically controlling the trapping or release is based on selecting on demand a pre-defined frequency configured to induce negative DEP (n-DEP) on the target particles.

18. The method according to claim 1, comprising:

applying a first electric field defined by a first pre-defined frequency for a first pre-defined time period, wherein the first pre-defined frequency is configured to induce p-DEP on the target particles;

applying a second electric field defined by a second pre-defined frequency for a second pre-defined time period subsequent to the first pre-defined time period, wherein the second pre-defined frequency is configured to induce n-DEP of any contaminants attached to the carrier; and applying a third electric field defined by a third pre-defined frequency for a third pre-defined time period subsequent to the second pre-defined time period, wherein the third pre-defined frequency is configured to induce transporting of the target particles trapped on the at least one carrier particle.

19. A device for dielectrophoresis comprising:

a micro-fluidic chamber comprising:

an electrolyte-solution with suspended target particles;

at least one carrier particle freely floating on or in the electrolyte-solution;

a first electrode and second electrode, each abutting a floor or a ceiling of the micro-fluidic chamber;

an AC source applying AC on the first and second electrode, wherein the AC induces an electric field across the micro-fluidic chamber, wherein the electric field is uniform absent said at least one carrier particle present in the micro-fluidic chamber, and wherein said at least one carrier particle induces a gradient to said electric field; and controller configured to dynamically control selective trapping of the target particles by said at least one carrier particle, and transporting trapped target particles from a first location in the chamber to a second location in the chamber distanced from the first location in a direction perpendicular to the direction of the electric field, by dynamically selecting a frequency of the AC.

20. The device according to claim 19, wherein said controller is also configured to dynamically control release of said trapped target particles from said at least one carrier particle, based on said dynamic selection of said frequency of the AC.

21. The device according to claim 20, wherein the controller is configured to select on demand a first pre-defined frequency configured to induce s-DEP of the at least one carrier particle.

22. The device according to claim 19, wherein the controller is configured to dynamically control trapping based on selection of a frequency of the AC and is configured to dynamically control transporting based on an externally applied magnetic field.

23. The device according to claim 22, wherein the at least one carrier particle includes magnetic functionalization.

24. The device according to claim 19, wherein the at least one carrier particle is a homogenous particle.

25. The device according to claim 19, wherein the at least one carrier particle is a symmetry broken particle.

26. The device according to claim 25, wherein the at least one carrier particle is a Janus particle.

27. The device according to claim 25, wherein the at least one carrier particle is at least one of a particle doublet, a cluster and a particle with a non-spherical shape.

28. The device according to claim 19, wherein the at least one carrier particle is functionalized with molecular biological probes.

29. The device according to claim 19, wherein the controller is configured to select on demand a pre-defined frequency configured to induce p-DEP on the target particles.

30. The device according to claim 29, wherein the controller is configured to select on demand a pre-defined frequency configured to induce n-DEP on any contaminants.

31. The device according to claim 19, wherein the controller is configured to select on demand a pre-defined frequency configured to induce n-DEP on the target particles.

* * * * *